US011622199B2

(12) United States Patent
Chou et al.

(10) Patent No.: US 11,622,199 B2
(45) Date of Patent: Apr. 4, 2023

(54) FLAT DIAPHRAGM SPEAKER

(71) Applicant: GLASS ACOUSTIC INNOVATIONS TECHNOLOGY CO., LTD., New Taipei (TW)

(72) Inventors: Yao-Sheng Chou, New Taipei (TW); Kwun Kit Chan, New Taipei (TW); Yi Feng Wei, New Taipei (TW); Hsiao-Yi Lin, New Taipei (TW)

(73) Assignee: GLASS ACOUSTIC INNOVATIONS TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/521,725

(22) Filed: Nov. 8, 2021

(65) Prior Publication Data

US 2022/0150636 A1 May 12, 2022

Related U.S. Application Data

(60) Provisional application No. 63/111,111, filed on Nov. 9, 2020.

(51) Int. Cl.

| | |
|---|---|
| ***H04R 7/04*** | (2006.01) |
| ***H04R 9/06*** | (2006.01) |
| ***H04R 31/00*** | (2006.01) |

(52) U.S. Cl.

CPC ..... *H04R 7/04* (2013.01); *H04R 9/06* (2013.01); *H04R 31/003* (2013.01)

(58) Field of Classification Search

None

See application file for complete search history.

(56) References Cited

U.S. PATENT DOCUMENTS

| | | | | |
|---|---|---|---|---|
| 9,736,576 | B2 | 8/2017 | Shinotsuka et al. | |
| 2006/0215874 | A1* | 9/2006 | Jiles | H04R 31/003 381/369 |
| 2018/0270569 | A1 | 9/2018 | Boyd | |
| 2021/0360350 | A1* | 11/2021 | Meng | H05K 1/0277 |

FOREIGN PATENT DOCUMENTS

| | | | |
|---|---|---|---|
| CN | 106954159 | A | 7/2017 |
| CN | 112637748 | A * | 4/2021 |
| EP | 2986025 | A2 | 2/2016 |

(Continued)

OTHER PUBLICATIONS

Extended European Search Report dated Apr. 4, 2022 issued by the European Patent Office for the European Patent Application No. 21206953.8-1207.

(Continued)

*Primary Examiner* — Walter F Briney, III

(74) *Attorney, Agent, or Firm* — WPAT, P.C., Intellectual Property Attorneys; Anthony King

(57) ABSTRACT

A hybrid diaphragm structure is provided. The hybrid diaphragm structure includes a substrate, a first diaphragm disposed in a central region of the substrate, a first coil structure disposed over the first diaphragm, a first groove separating the first diaphragm and the first coil structure from the substrate, and a first bridge structure coupling the first diaphragm to the substrate. The first diaphragm and the substrate include a same material.

19 Claims, 28 Drawing Sheets

(56) References Cited

FOREIGN PATENT DOCUMENTS

TW M269678 U 7/2005

OTHER PUBLICATIONS

U.S. Pat. No. 9,736,576B2 Corresponds to EP2986025A2.
Office Action, Cited References and Search Report dated Dec. 7, 2022 issued by Taiwan Intellectual Property Office for counterpart application. No. 17521725.
Brief English translation of Office Action, Cited References and References on Search Report dated Dec. 7, 2022 issued by Taiwan Intellectual Property Office for counterpart application No. 17521725.
Abstract of foreign citation TW M269678.
Abstract of foreign citation CN 106954159.

* cited by examiner

FLAT DIAPHRAGM SPEAKER

PRIORITY CLAIM AND CROSS-REFERENCE

This application claims the benefit of provisional application Ser. 63/111,111 filed on Nov. 9, 2020. The above-referenced application is hereby incorporated herein by reference in its entirety.

BACKGROUND

With rapid development of both electronics and information industries, multimedia player devices are evolving with increased miniaturization and portability. For example, an electronic portable media player (PMP) or digital audio player (DAP) is a portable electronic device that can store and play multimedia files. The above-mentioned devices require speakers for sound playing, but the existing speaker structure and manufacturing technology are disadvantageous for integration into multimedia player devices that need to be light, thin, and short. In order to cure such deficiency, the following technical means have been developed.

SUMMARY OF THE INVENTION

One aspect of the present invention provides a hybrid diaphragm structure, a flat diaphragm speaker including the hybrid diaphragm structure, and methods for forming the flat diaphragm speaker with the hybrid diaphragm structure. The hybrid diaphragm structure includes a voice coil integrated on the diaphragm, which helps to achieve miniaturization. Further, methods for forming the hybrid diaphragm can be integrated in a semiconductor manufacturing process. Thus the flat diaphragm speaker including the hybrid diaphragm structure may be integrated with other applications such as LED/OLED display. Practicality of the flat diaphragm speaker is therefore further improved.

The present invention provides a hybrid diaphragm structure. The hybrid diaphragm structure includes a substrate, a first diaphragm disposed in a central region of the substrate, a first coil structure disposed over the first diaphragm, a first groove separating the first diaphragm and the first coil structure from the substrate, and a first bridge structure coupling the first diaphragm to the substrate. The first diaphragm and the substrate include a same material.

The present invention provides a flat diaphragm speaker. The flat diaphragm speaker includes a first substrate, a second substrate, a frame coupling the first substrate to the second substrate, a hybrid diaphragm disposed within the first substrate, a groove separating the hybrid diaphragm from the first substrate, and at least a bridge structure coupling the hybrid diaphragm to the first substrate. The second substrate has a first surface facing the first substrate and a second surface opposite to the first surface. The hybrid diaphragm includes a vibrating part and a coil structure. The vibrating part of the hybrid diaphragm has a third surface facing the second substrate and a fourth surface opposite to the third surface. The coil structure is disposed over the third surface of the vibrating part. The first substrate and the vibrating part of the hybrid diaphragm include a same material.

BRIEF DESCRIPTION OF THE DRAWINGS

FIGS. 14, 15, 16A and 16B are schematic drawings of a hybrid diaphragm structure at various fabrication stages constructed according to aspects of the present disclosure in one or more embodiments, wherein FIG. 16B is a top view of FIG. 16A.

DETAILED DESCRIPTION

In the following detailed description, numerous specific details are set forth in order to provide a thorough understanding of the present disclosure. However, it will be understood by those skilled in the art that the present disclosure may be practiced without these specific details. In other instances, well-known methods, procedures, components and circuits are not described in detail so as not to obscure the present disclosure.

The present invention provides a variety of embodiments useful in the realization of diaphragm that provides significant performance advantages over other types of diaphragm used in speakers.

The making and using of the embodiments of the present disclosure are discussed in detail below. It should be appreciated, however, that the provided subject matter provides many applicable inventive concepts that may be embodied in a wide variety of specific contexts. The specific embodiments discussed herein are merely illustrative and do not limit the scope of the provided subject matter.

Figure 1:
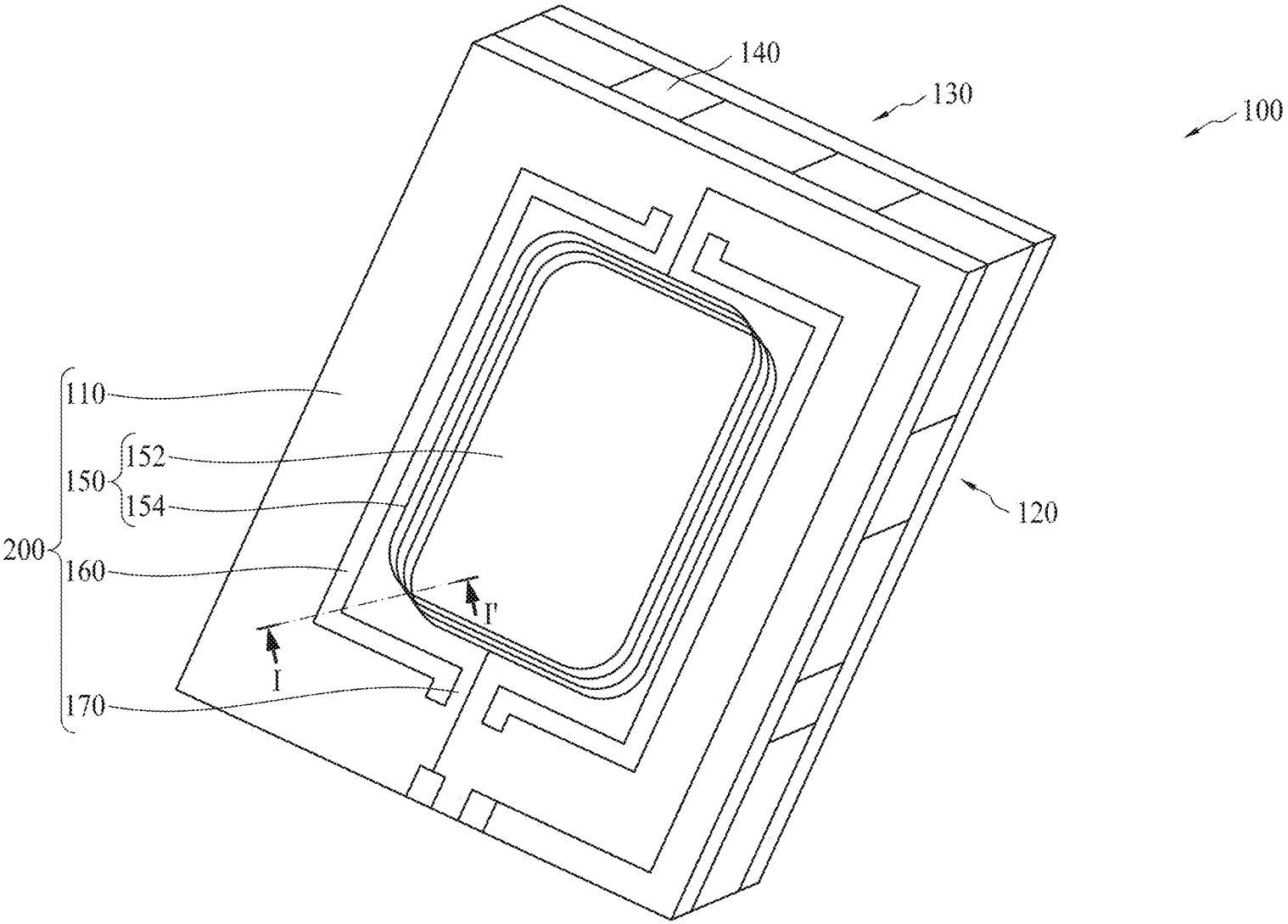
FIG. 1 is a schematic drawing of a flat diaphragm speaker in accordance with some embodiments of the present disclosure.
Figure 2D:
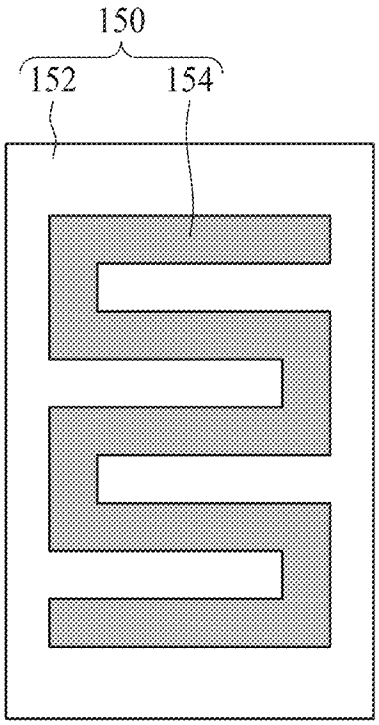
FIGS. 2A to 2D are schematic drawings illustrating different coil structures in accordance with some embodiments of the present disclosure.
Figure 2C:
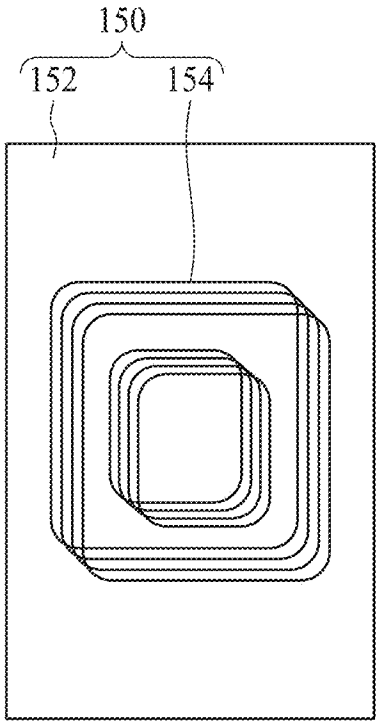
Figure 2B:
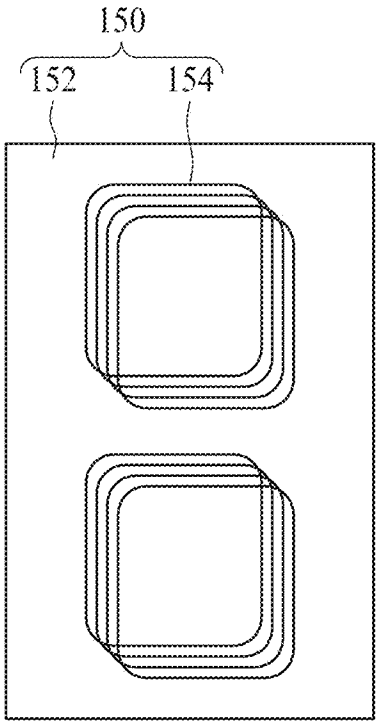
Figure 2A:
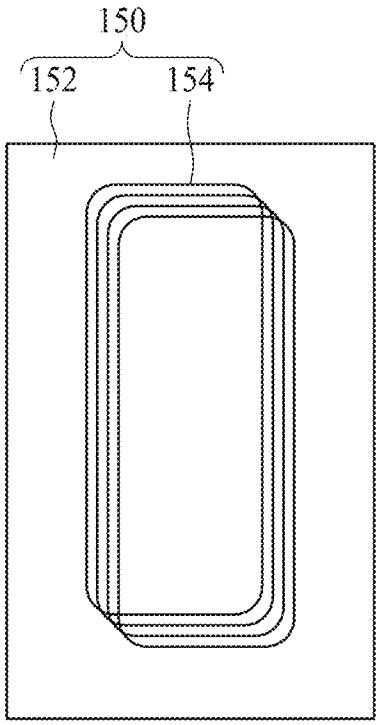

Referring to FIG. 1, a flat diaphragm speaker 100, such as a flat glass diaphragm speaker, is provided in accordance with some embodiments of the present disclosure. The flat diaphragm speaker 100 includes a first substrate 110, a second substrate 120, and a frame 130 coupling the first substrate 110 to the second substrate 120. The first substrate 110 and the second substrate 120 may include a same material. For example, the first substrate 110 and the second substrate 120 may both include glass or quartz, but the disclosure is not limited thereto. In other embodiments, the first substrate 110 and the second substrate 120 may include different materials. For example, the first substrate 110 may include glass or quartz, while the second substrate 120 may include metal or PCB. In some embodiments, the first substrate 110 may be referred to as an upper glass substrate, while the second substrate 120 may be referred to as a lower glass substrate, but the disclosure is not limited thereto. In some embodiments, a thickness of the first substrate 110 and a thickness of the second substrate 120 may respectively between approximately 0.03 mm and approximately 0.7 mm, but the disclosure is not limited thereto. In some embodiments, the thickness of the first substrate 110 and the thickness of the second substrate 120 may respectively be between approximately 0.03 mm and approximately 0.1 mm, but the disclosure is not limited thereto. The thickness of the first substrate 110 and the thickness of the second substrate 120 may be same or different, depending on product or process requirements.

The frame 130 may include a sealant. In some embodiments, the sealant may be an epoxy-based resin. It is preferable that such material allows as little moisture and oxygen as possible to penetrate the frame 130. Further, as a material for the substrates, glass, quartz, or a plastic made of fiberglass-reinforced plastics (FRP), polyvinyl fluoride (PVF), polyester, acrylic, or the like can be used. In some embodiments, a thickness of the frame 130 may define a distance between the first substrate 110 and the second substrate 120, but the disclosure is not limited thereto.

Figure 6:
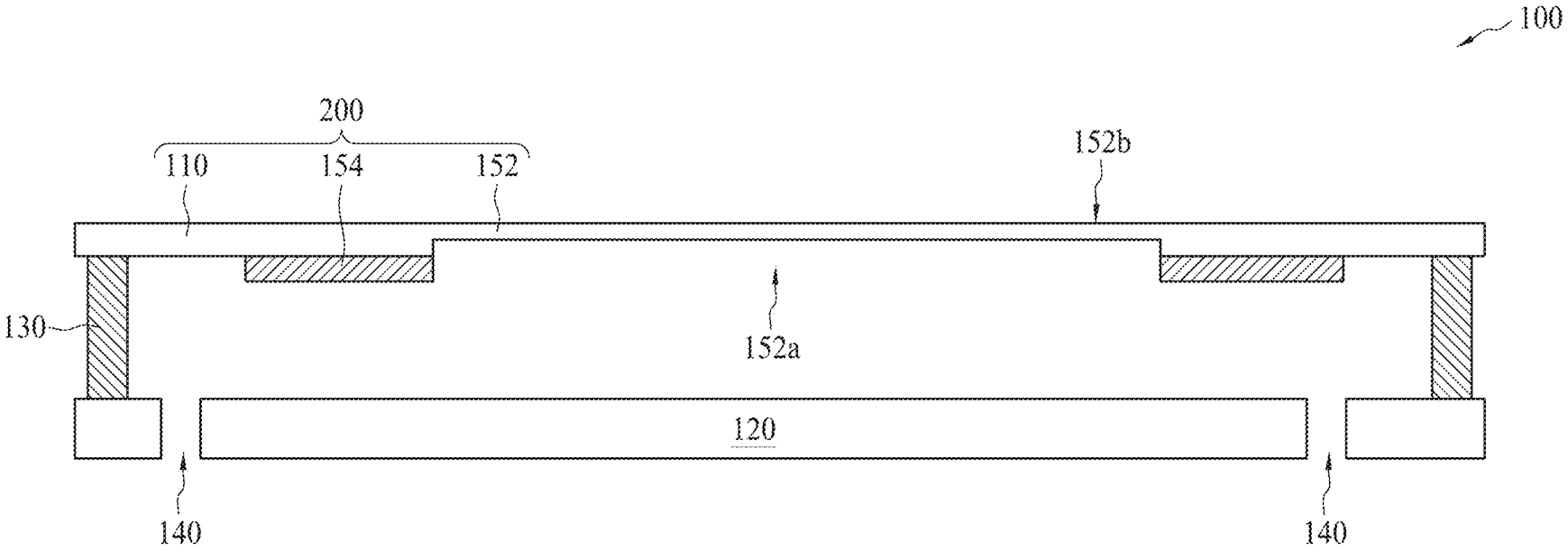
FIG. 6 is a schematic drawing of a flat diaphragm speaker in accordance with some embodiments of the present disclosure.
Figure 7:
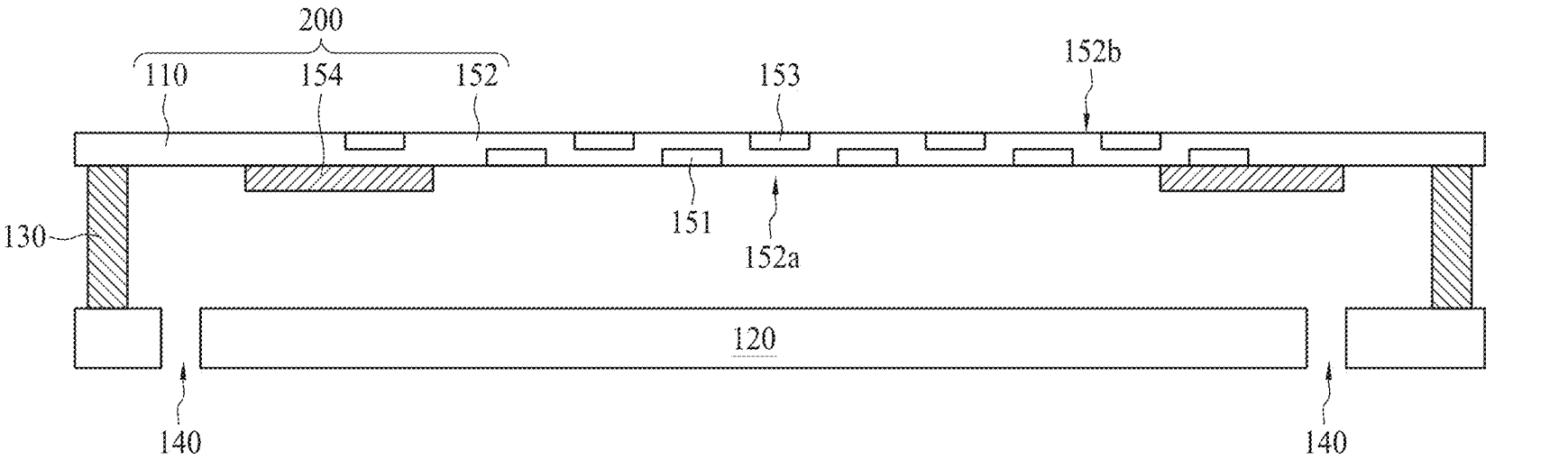
FIG. 7 is a schematic drawing of a flat diaphragm speaker in accordance with some embodiments of the present disclosure.

In some embodiments, a hole 140 may be formed to penetrate the second substrate 120 (as shown in FIGS. 6 and 7), but the disclosure is not limited thereto. For example, in some embodiments, the hole 140 is formed to penetrate the frame 130, as shown in FIG. 1. A quantity or arrangement of the holes 140 may adjusted or modified according to product requirements. The hole 140 is used to improve resonance.

Figure 3:
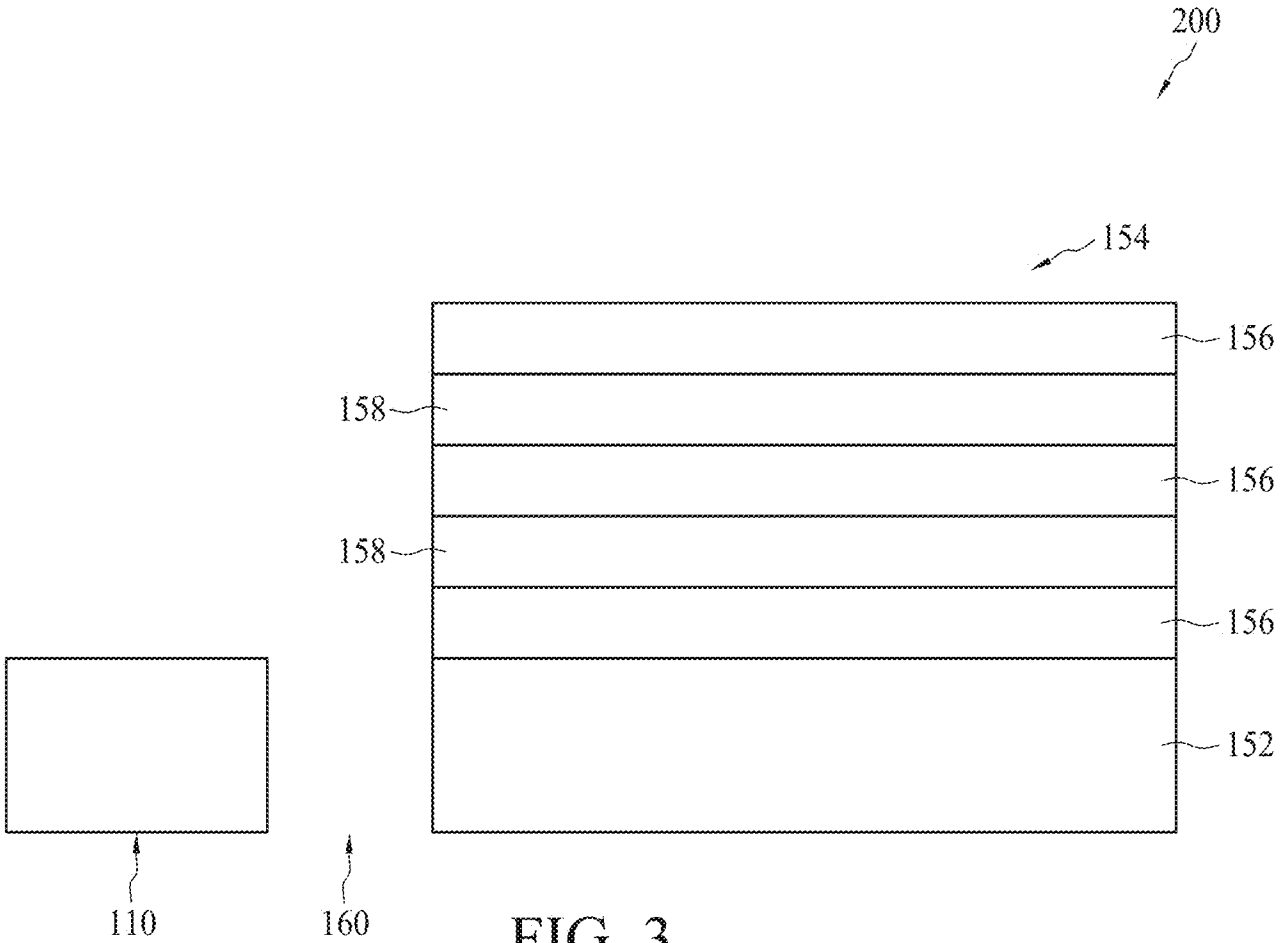
FIG. 3 is a cross-sectional view taken along line I-I' of FIG. 1 in accordance with some embodiments of the present disclosure.
Figure 4:
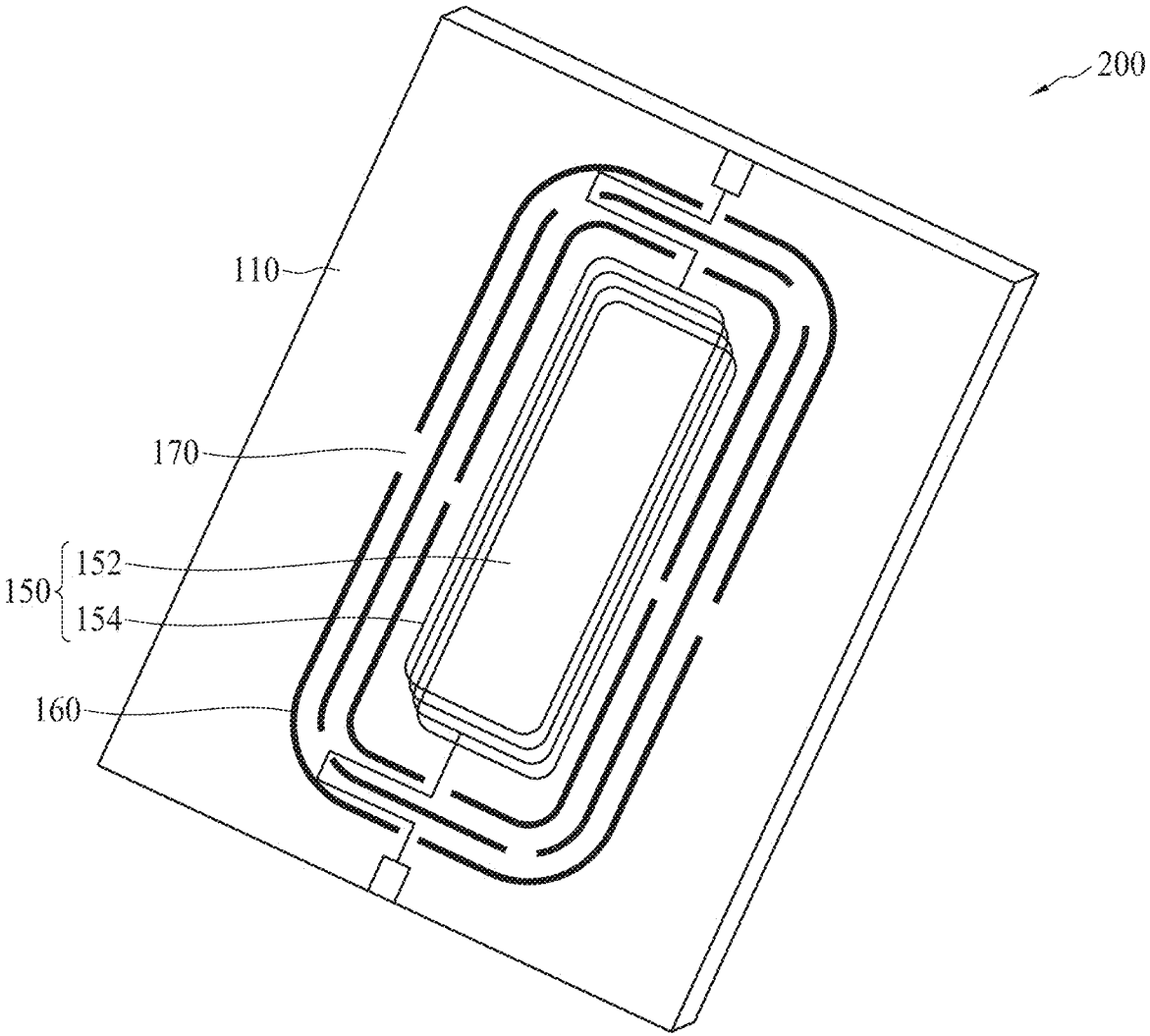
FIG. 4 is a schematic drawing of a hybrid diaphragm structure of the flat diaphragm speaker in accordance with some embodiments of the present disclosure.

Referring to FIGS. 1 to 3, the flat diaphragm speaker 100 includes a hybrid diaphragm 150 disposed within the first substrate 110. In some embodiments, the hybrid diaphragm 150 is disposed in a central region of the first substrate 110, as shown in FIG. 1, but the disclosure is not limited thereto. In some embodiments, the first substrate 110 and the hybrid diaphragm 150 may be referred to as a hybrid diaphragm structure 200. Still referring to FIG. 1, the hybrid diaphragm 150 may include a vibrating part (also referred to as a diaphragm) 152 and a coil structure 154 (also referred to as a voice coil) disposed over a surface of the vibrating part 152 facing the second substrate 120. Referring to FIGS. 2A to 2D, shapes and patterns of the coil structure 154 may be different depending on product requirements. Referring to FIGS. 3 and 4, the coil structure 154 may include multiple conductive coils 156 and multiple insulating layers 158 separating the conductive coils 156. Operations for forming the conductive coils 156 and the insulating layers 158 will be described below.

The flat diaphragm speaker 100 further includes a groove 160 separating the hybrid diaphragm 150 (i.e., the diaphragm 152 and the coil structure 154) from the first substrate 110. It should be noted that the vibrating part (i.e., the diaphragm) 152 and the first substrate 110 include a same material. In some embodiments, a dimension and a shape of the hybrid diaphragm 150 are defined by the groove 160, as shown in FIG. 1. Thus, the hybrid diaphragm 150 may have a polygonal (e.g., rectangular) shape, a circular shape, or an oval shape. A depth of the groove 160 is equal to the thickness of the first substrate 110. Further, the flat diaphragm speaker 100 includes a bridge structure 170 coupling the hybrid diaphragm 150 to the first substrate 110. Accordingly, the hybrid diaphragm 150, including the diaphragm 152 and the coil structure 154, may vibrate from an equilibrium position, which is defined by the bridge structure 170. The bridge structure 170 therefore may serve as a clamper. Further, a compliance of the clamper may be modified by adjusting a length, a width, and/or a thickness of the bridge structure 170. It should be noted that when the depth of the groove 160 is equal to the thickness of the first substrate 110, as shown in FIG. 3, the hybrid diaphragm 150 is suspended and connected to the first substrate 110 merely by the bridge structure 170. Therefore, the compliance is modified by the length, the width, and/or the thickness of the bridge structure 170, as mentioned above.

Referring to FIG. 4, as mentioned above, the groove 160 not only defines the shape and the dimension of the diaphragm 152, but also functions with a quantity of the bridge structure 170 to serve as clampers of the hybrid diaphragm 150. As shown in FIG. 4, by adjusting the quantity of the bridge structure 170 between the grooves 160, the widths of the bridge structures 170, the lengths of the bridge structures 170 and the thicknesses of the bridge structures 170, the compliance of the hybrid diaphragm 150 can be modified.

Figure 5:
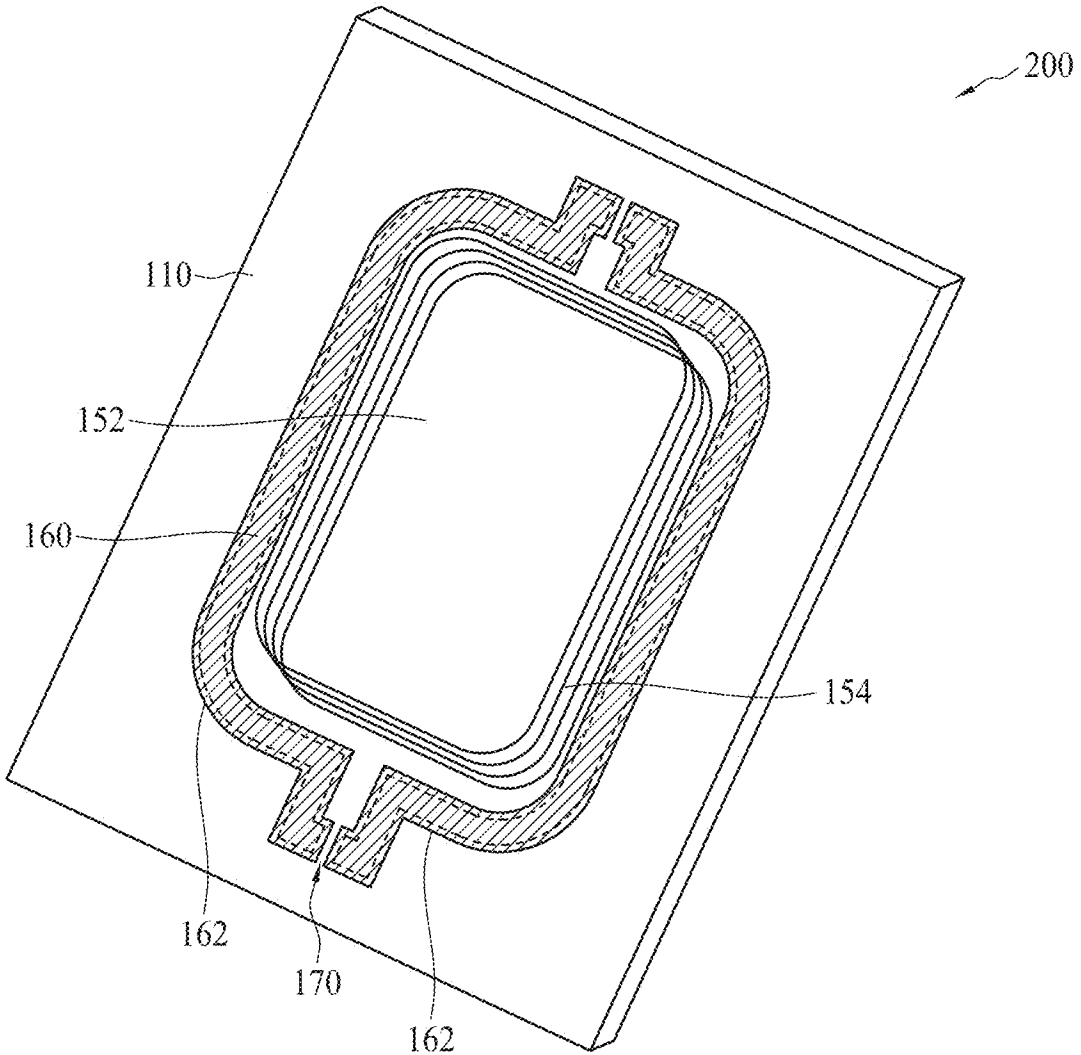
FIG. 5 is a schematic drawing of a hybrid diaphragm structure of the flat diaphragm speaker in accordance with some embodiments of the present disclosure.

Referring to FIG. 5, in some embodiments, a material layer 162 is disposed over the groove 160 and couples the first substrate 110 to the diaphragm 152. The material layer 162 may include a IN-curable material. In some embodiments, the material layer 162 serves as a surround and a clamper, and thus a thickness and a hardness of the material layer 162 may be adjusted to modify the compliance.

In some embodiments, the diaphragm 152 may have a reduced weight. For example, a thickness of the first substrate 110 and a thickness of the diaphragm 152 are simultaneously reduced. In other embodiments, the thickness of the diaphragm 152 may be reduced. Referring to FIG. 6, the thickness of the diaphragm 152 is reduced to less than the thickness of the first substrate 110. In some embodiments, the diaphragm 152 has a first surface 152*a* facing the second substrate 120, and a second surface 152*b* opposite to the first surface 152*a*, In such embodiments, the second surface 152*b* may be aligned with an external surface (i.e., a surface facing an ambient) of the first substrate 110, as shown in FIG. 7, but the disclosure is not limited thereto.

Figure 8:
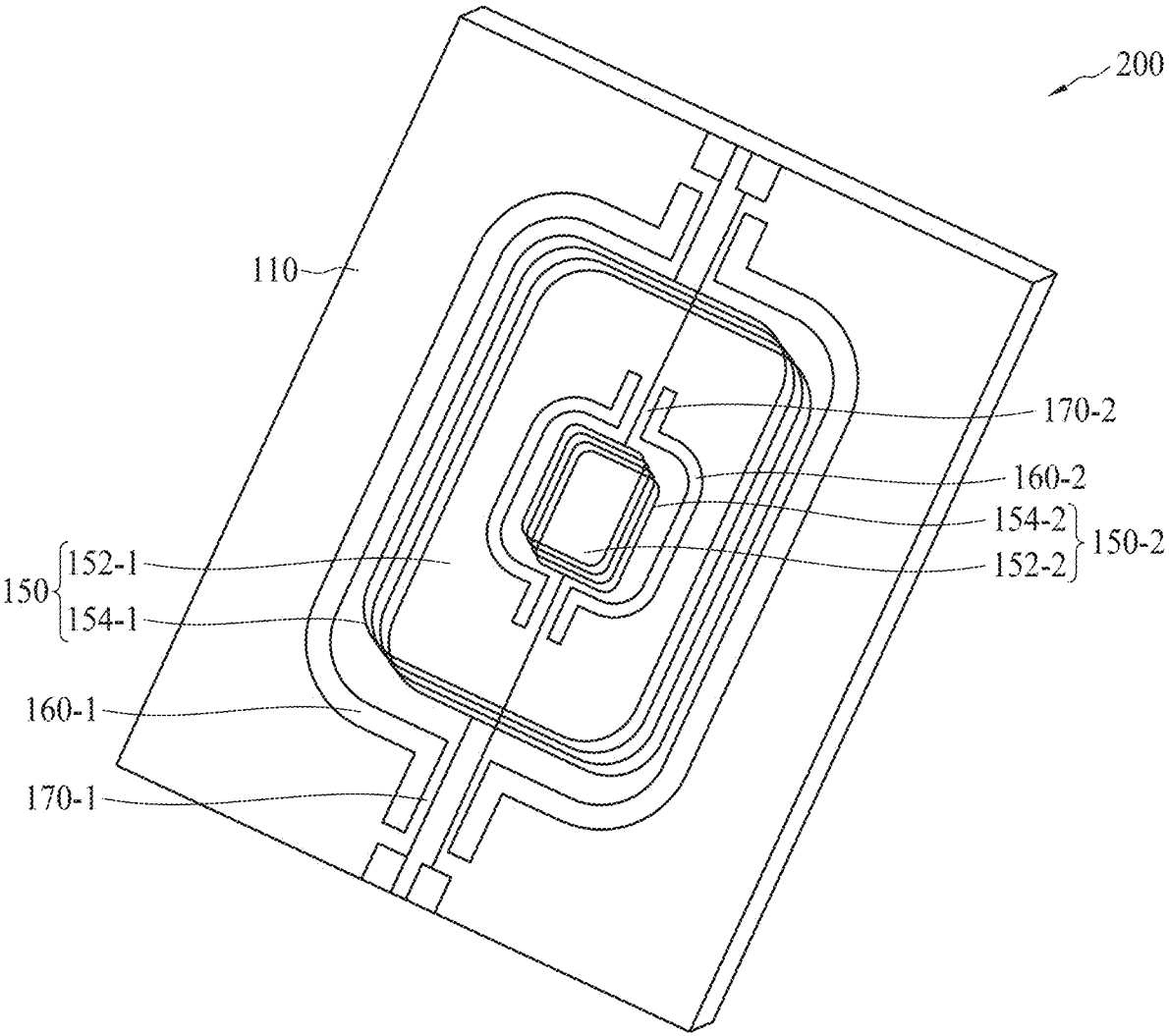
FIG. 8 is a schematic drawing of a hybrid diaphragm structure of the flat diaphragm speaker in accordance with some embodiments of the present disclosure.

In some embodiments, other approaches may be provided to comply with a low-weight requirement. For example, multiple recesses 151 may be formed over the first surface 152*a* of the diaphragm 152. The recesses 151 are indented from the first surface 152*a* toward the second surface 152*b*. In other embodiments, multiple recesses 153 may be formed over the second surface 152*b* of the diaphragm 152, and indented from the second surface 152*b* toward the first surface 152*a*. Further, in some embodiments, the recesses 151 are formed over the first surface 152*a* of the diaphragm 152, while the recesses 153 are formed over the second surface 152*b* of the diaphragm 152, as shown in FIG. 7. The recesses 151 and the recesses 153 are alternately arranged. In some embodiments, the recesses 151 and the recesses 153 are arranged to form a pattern. For example, the recesses 151 and the recesses 153 may be arranged to form a beehive pattern, but the disclosure is not limited thereto. In some embodiments, the coil structure 154 surrounds the pattern, as shown in FIG. 8. The coil structure 154 may be offset from the recesses 151 and 153. Alternatively, the coil structure 154 may overlap the recesses 151 and/or 153, depending on product requirements.

Figure 9:
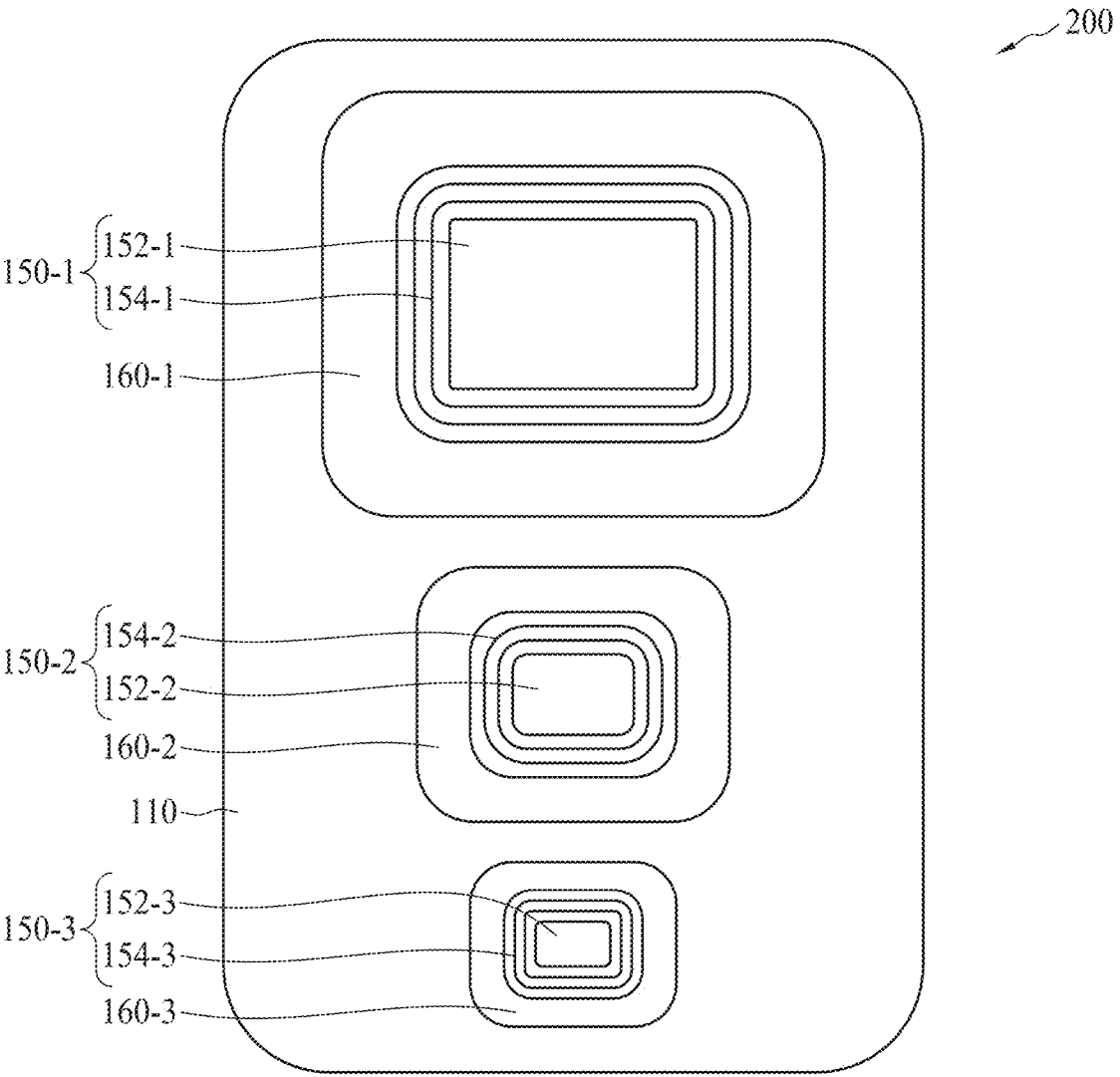
FIG. 9 is a schematic drawing of a hybrid diaphragm structure of the flat diaphragm speaker in accordance with some embodiments of the present disclosure.

Referring to FIG. 8, the flat diaphragm speaker 100 may include a plurality of hybrid diaphragms 150-1 and 150-2. In some embodiments, a dimension of the hybrid diaphragm 150-1 is different from a dimension of the hybrid diaphragm 150-2. In some embodiments, the hybrid diaphragms 150-1 is disposed in a central region of the first substrate 110, and the hybrid diaphragms 150-2 is disposed in a central region of the hybrid diaphragms 150-1. The hybrid diaphragm 150-1 includes a vibrating part (i.e., the diaphragm) 152-1, and a coil structure 154-1 over the vibrating part 152-1. The hybrid diaphragm 150-1 is separated from the first substrate 110 by the groove 160-1, and is coupled to the first substrate 110 by the bridge structure 170-1. The hybrid diaphragm 150-2 includes a vibrating part (i.e., a diaphragm) 152-2, and a coil structure 154-2 over the vibrating part 152-2. Additionally, the coil structures 154-1 and 154-2 are disposed over a same side of the first substrate 110. As shown in FIG. 9, the hybrid diaphragm 150-2 is separated from the hybrid diaphragm 150-1 by a groove 160-2, and is coupled to the hybrid diaphragm 150-1 by a bridge structure 170-2. In some embodiments, the hybrid diaphragms 150-1 and 150-2 are arranged to form a concentric pattern, as shown in FIG. 9, but the disclosure is not limited thereto. In such embodiments, the bridge structures 170-1 and 170-2 are aligned with each other. Thus, the hybrid diaphragm 150-1 and the hybrid diaphragm 150-2 may independently vibrate with different frequencies. Further, the frequencies of the hybrid diaphragm 150-1 and the hybrid diaphragm 150-2 may be modified by adjusting a dimension of the diaphragms 152-1 and 152-2, and adjusting compliances of the diaphragms 152-1 and 152-2, As mentioned above, shapes and dimensions of the diaphragms 152-1 and 152-2 are defined by the grooves 160-1 and 160-2. Compliances of the hybrid diaphragms 150-1 and 150-2 may be modified by adjusting amounts of the grooves 160-1 and 160-2, lengths of the bridge structures 170-1 and 170-2, widths of the bridge structures 170-1 and 170-2, thicknesses of the bridge structures 170-1 and 170-2, and a thickness and a hardness of a material layer (not shown) over the grooves 160-1 and 160-2.

It should be noted that arrangement of the hybrid diaphragms 150-1 and 150-2 is not limited to the above-mentioned pattern. Referring to FIG. 9, the flat diaphragm speaker 100 may include a plurality of hybrid diaphragms 150-1, 150-2 and 150-3. The hybrid diaphragms 150-1, 150-2 and 150-3 are arranged according to different product requirements. For example, the hybrid diaphragms 150-1, 150-2 and 150-3 may be arranged along a central axis of the first substrate 110. Further, the hybrid diaphragms 150-1, 150-2 and 150-3 may be respectively symmetric to the central axis of the first substrate 110, but the disclosure is not limited thereto. In some embodiments, a dimension of the hybrid diaphragm 150-1, a dimension of the hybrid diaphragm 150-2 and a dimension of the hybrid diaphragm 150-3 are different from each other. The hybrid diaphragms 150-1, 150-2 and 150-3 are separated from each other by the first substrate 110. The hybrid diaphragm 150-1 includes the diaphragm 152-1 and the coil structure 154-1 over the diaphragm 152-1. Further, the hybrid diaphragm 150-1 is separated from the first substrate 110 by a groove 160-1, and is coupled to the first substrate 110 by a bridge structure (not shown). The hybrid diaphragm 150-2 includes the diaphragm 152-2 and the coil structure 154-2 over the diaphragm 152-2. Further, the hybrid diaphragm 150-2 is separated from the first substrate 110 by a groove 160-2, and is coupled to the first substrate 110 by a bridge structure (not shown). The hybrid diaphragm 150-3 includes a diaphragm 152-3 and a coil structure 154-3 over the diaphragm 152-3. Further, the hybrid diaphragm 150-3 is separated from the first substrate 110 by a groove 160-3, and is coupled to the first substrate 110 by a bridge structure (not shown). In some embodiments, the bridge structures of the hybrid diaphragms 150-1, 150-2 and 150-3 may be aligned with the central axis of the first substrate 110. In other embodiments, the bridge structures of the hybrid diaphragms 150-1, 150-2 and 150-3 may have different arrangements. Consequently, the hybrid diaphragms 150-1, 150-2 and 150-3 may independently vibrate with different frequencies. Further, the frequencies of the hybrid diaphragms 150-1, 150-2 and 150-3 may be modified by adjusting dimensions of the diaphragms 152-1, 152-2 and 150-3, and adjusting compliances of the diaphragms 152-1, 152-2 and 150-3. As mentioned above, shapes and dimensions of the diaphragms 152-1, 150-2 and 150-3 are defined by the grooves 160-1, 160-2 and 160-3. Compliances of the hybrid diaphragms 150-1, 150-2 and 150-3 may be modified by adjusting amounts of the grooves 160-1, 160-2 and 160-3, lengths of the bridge structures, widths of the bridge structures, thicknesses of the bridge structures, and a thickness and a hardness of a material layer (not shown) over the grooves 160-1, 160-2 and 160-3.

Figure 10A:
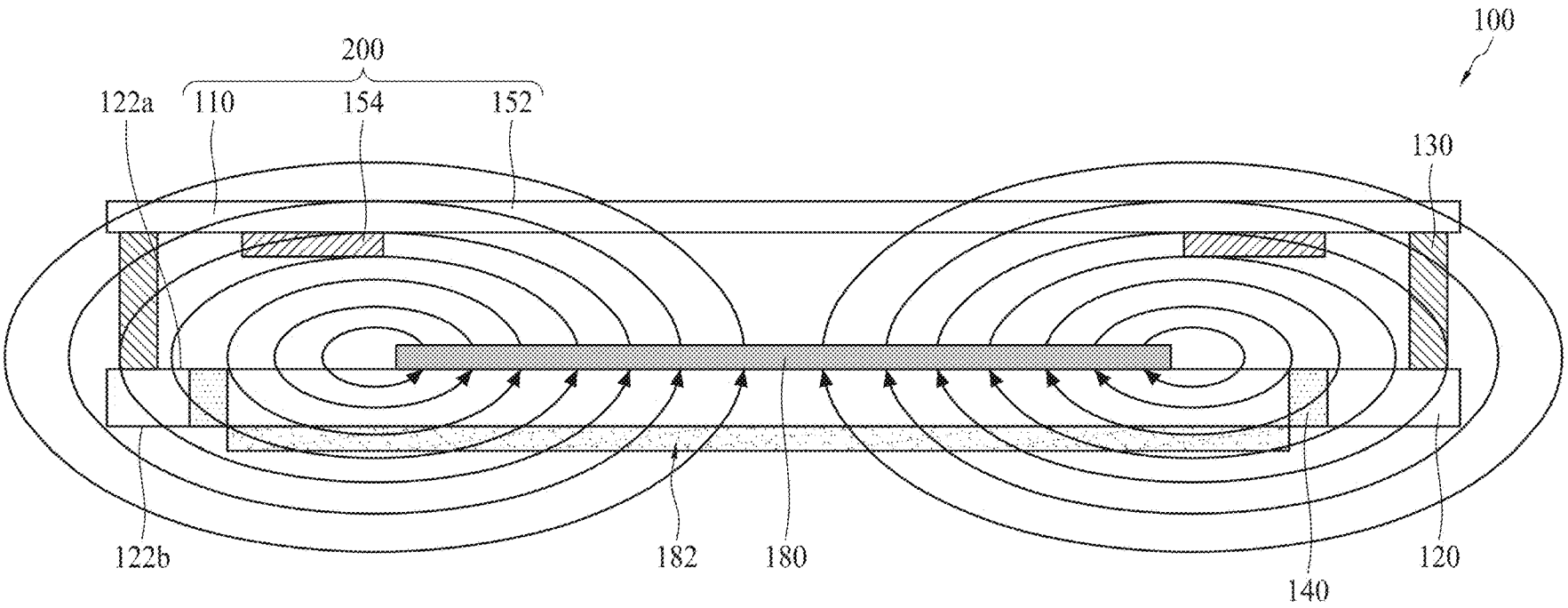
FIG. 10A is a schematic drawing of a flat diaphragm speaker.
Figure 10B:
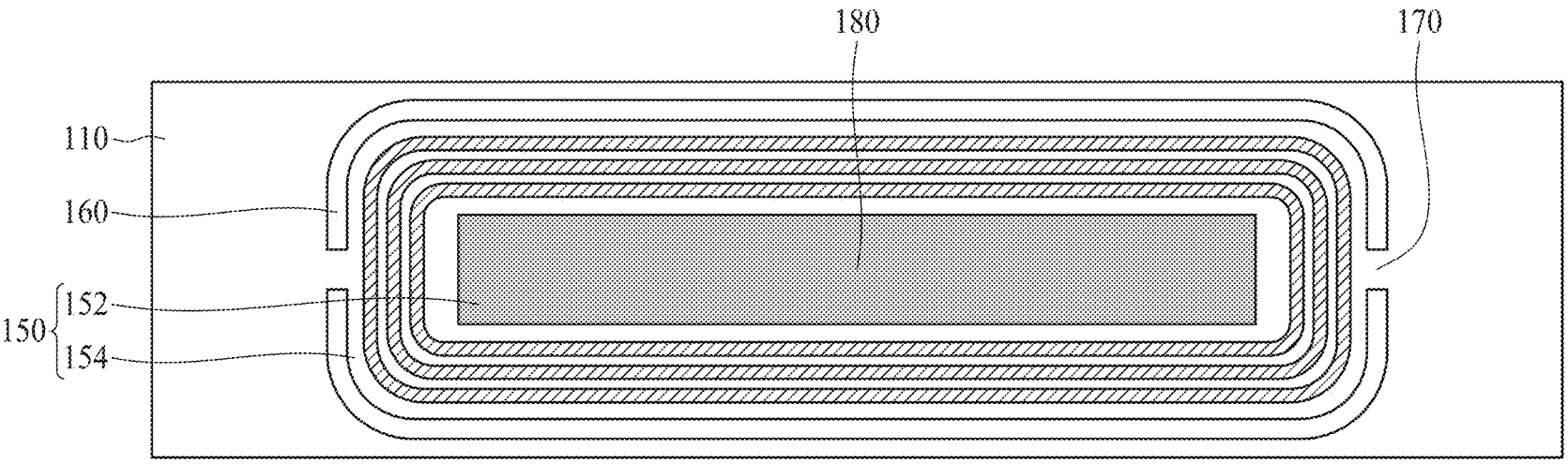
FIG. 10B is a top view of a hybrid diaphragm structure of the flat diaphragm speaker in accordance with some embodiments of the present disclosure.

Referring to FIGS. 10*a* and 10*b*, a magnet 180 is disposed over the second substrate 120. In some embodiments, the magnet 180 is disposed over a surface 122*a* of the second substrate 120 that faces the first substrate 110. Additionally, a pulse density modulation (PDM) driving IC and circuit 182 including an amplifier and Bluetooth functionality may be disposed over a surface 122*b* of the second substrate 120 that is opposite to the magnet 180. Further, the poles of the magnet 180 are arranged to face the first substrate 110 and the second substrate 120, respectively. The magnet 180 over the second substrate 120 provides a magnetic field that is able to improve a performance of the flat diaphragm speaker 100.

Figure 11:
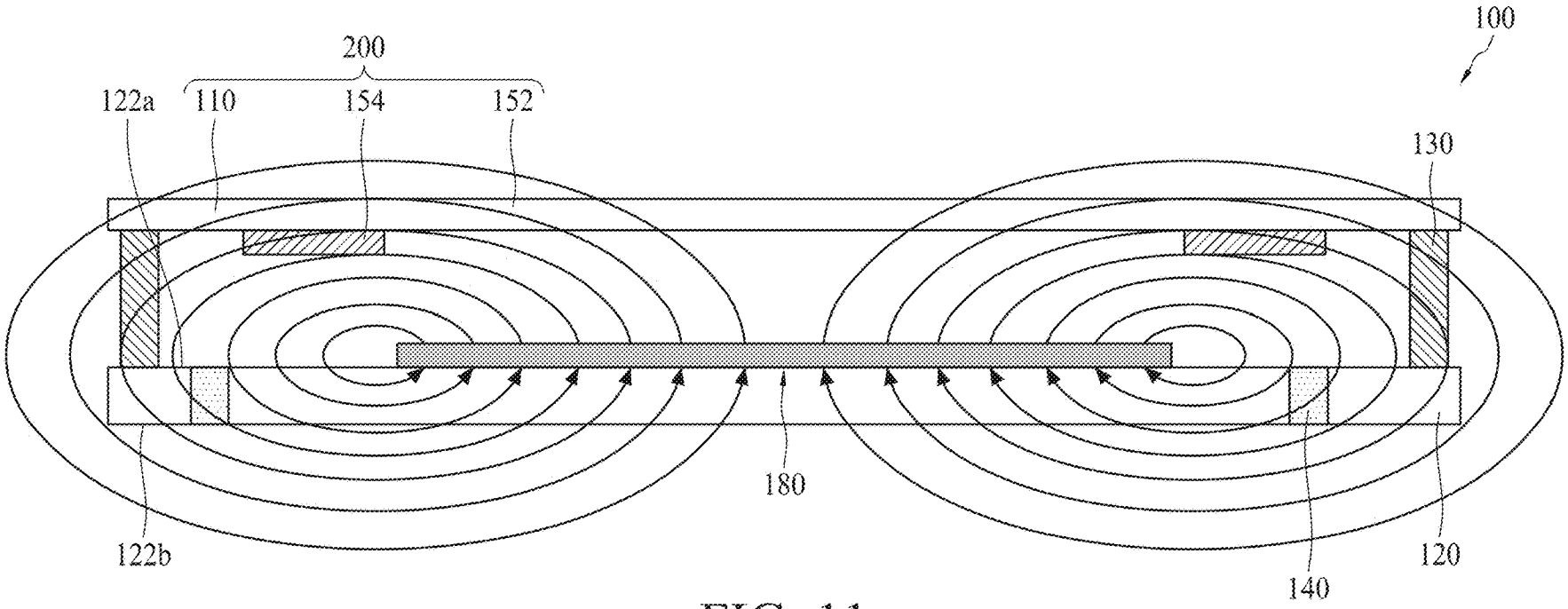
FIG. 11 is a schematic drawing of a flat diaphragm speaker in accordance with some embodiments of the present disclosure.
Figure 12:
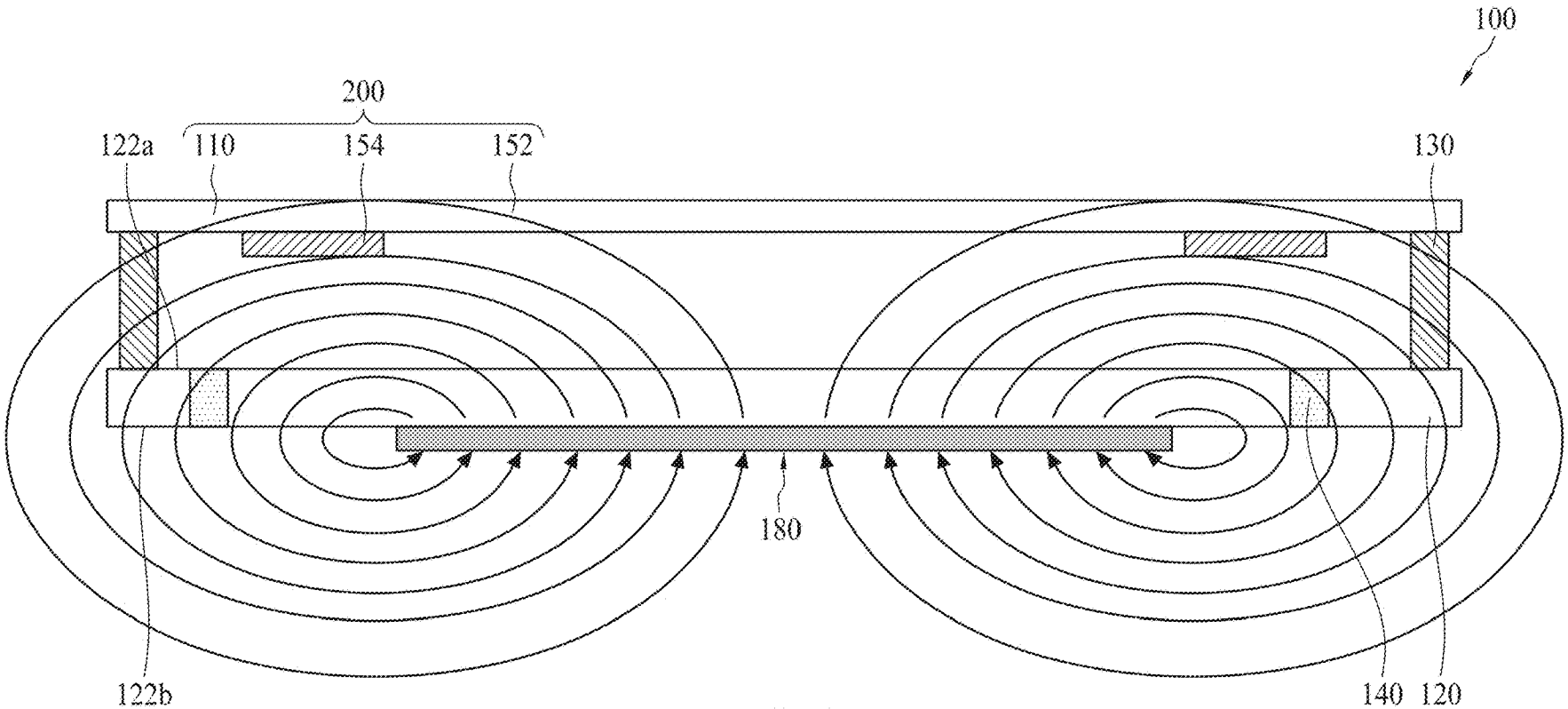
FIG. 12 is a schematic drawing of a flat diaphragm speaker in accordance with some embodiments of the present disclosure.
Figure 13:
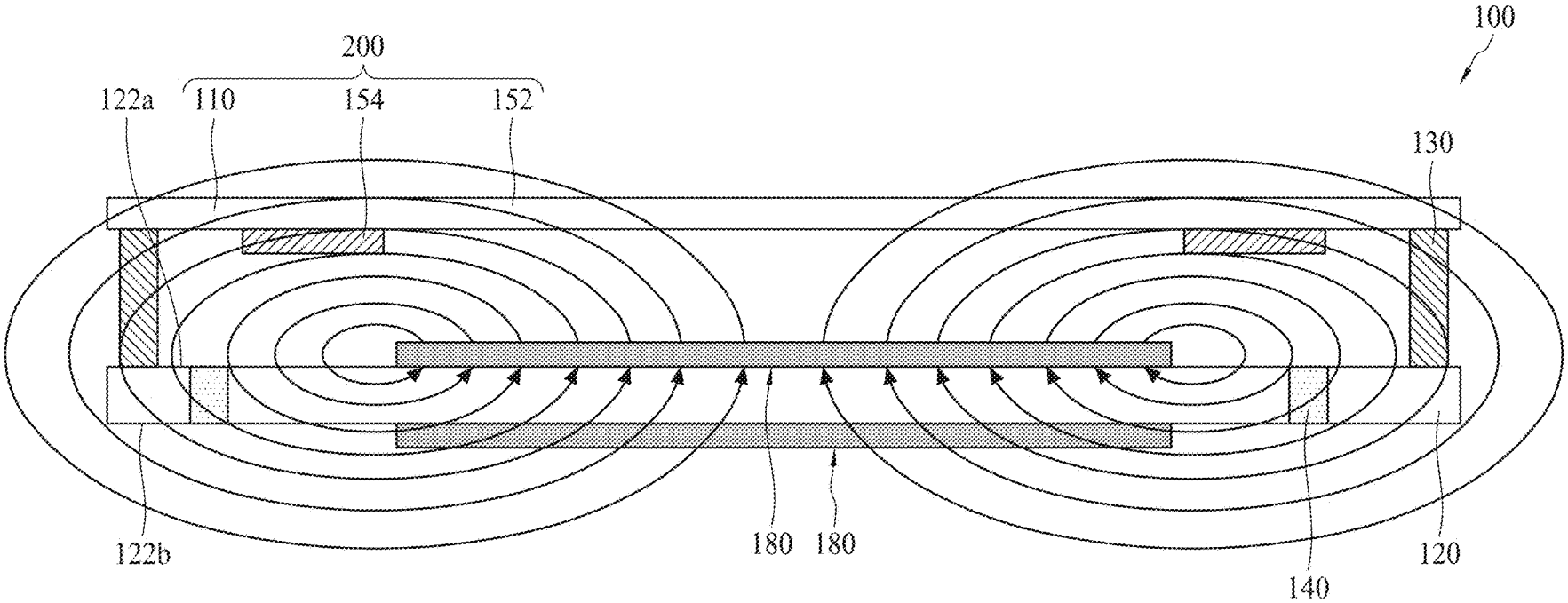
FIG. 13 is a schematic drawing of a flat diaphragm speaker, in accordance with some embodiments of the present disclosure.
Figure 14:
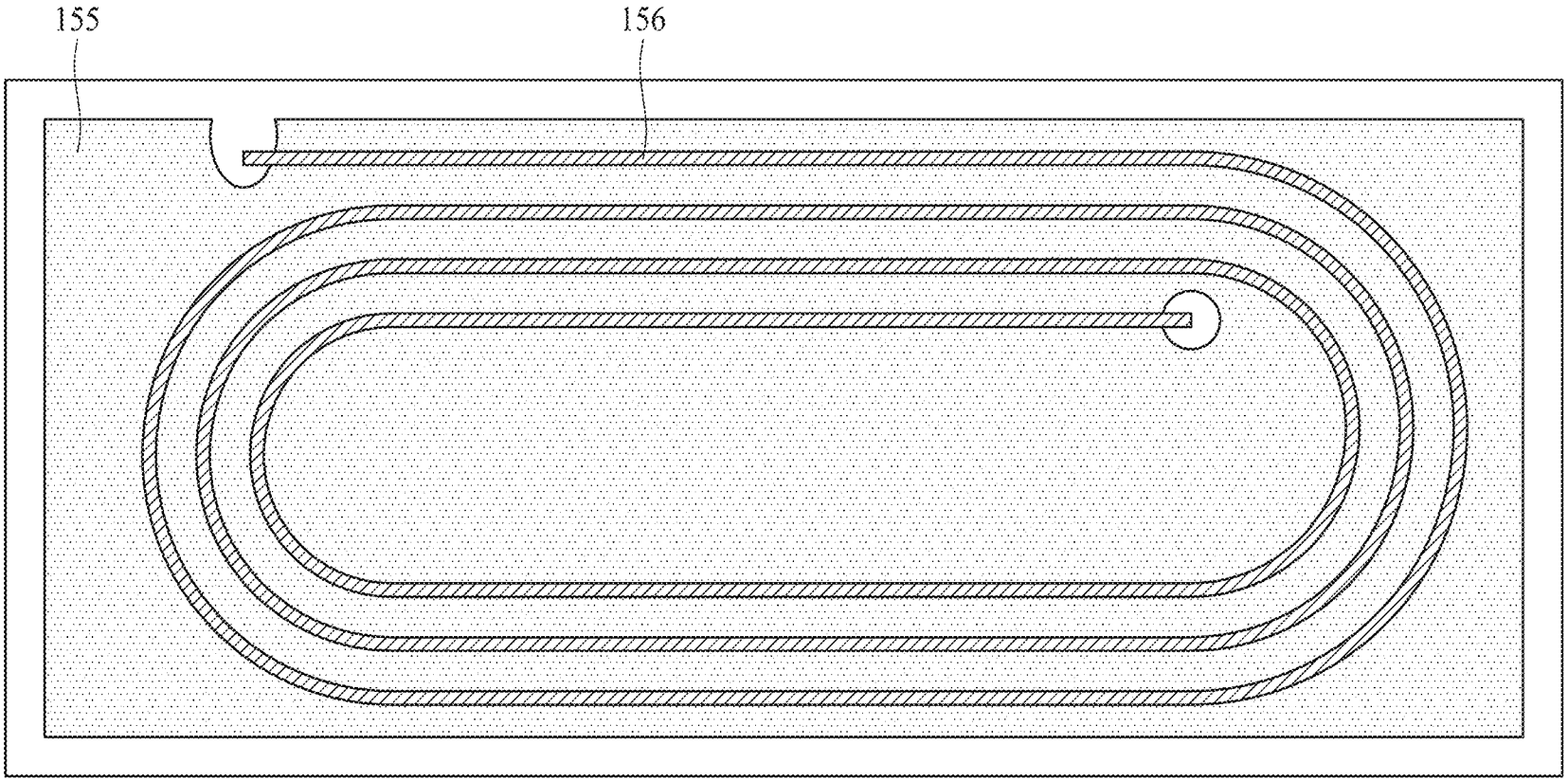

In some embodiments, the pulse density modulation (PDM) driving IC and circuit 182 may be omitted from the second substrate 120, as shown in FIG. 11. In some embodiments, the magnet 180 may be disposed over the surface 122*b*, as shown in FIG. 12. In still other embodiments, two magnets 180 are disposed over the two surfaces 122*a* and 122*b* of the second substrate 120, thus increasing the magnetic flux, as shown in FIG. 13.

The abovementioned hybrid diaphragm structure 200 of the flat diaphragm speaker 100 may be formed by many suitable methods. FIGS. 14 to 16B are drawings illustrating various stages of a method for forming a hybrid diaphragm structure 200. In such embodiments, a conductive coil 156 of the coil structure 154 is formed from a metal foil 155, such as a copper foil. A pattern of the conductive coil 156 may include patterns shown in FIGS. 2A to 2D, but the disclosure is not limited thereto.

Figure 15:
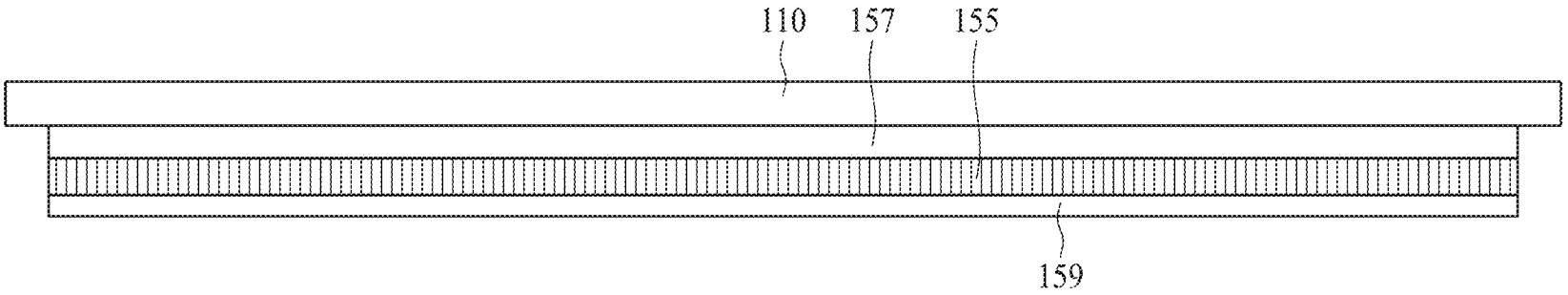
Figure 16A:
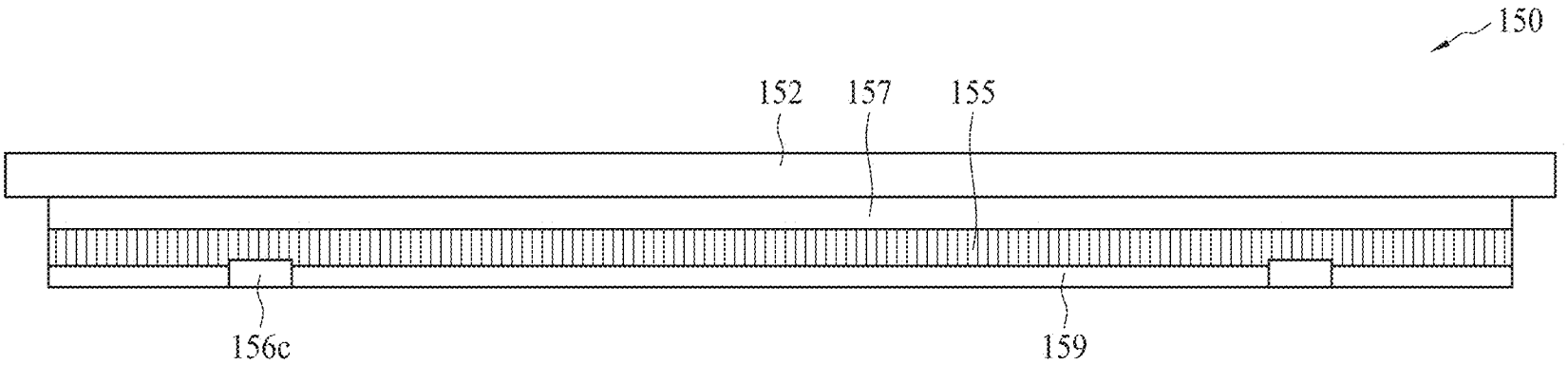
Figure 16B:
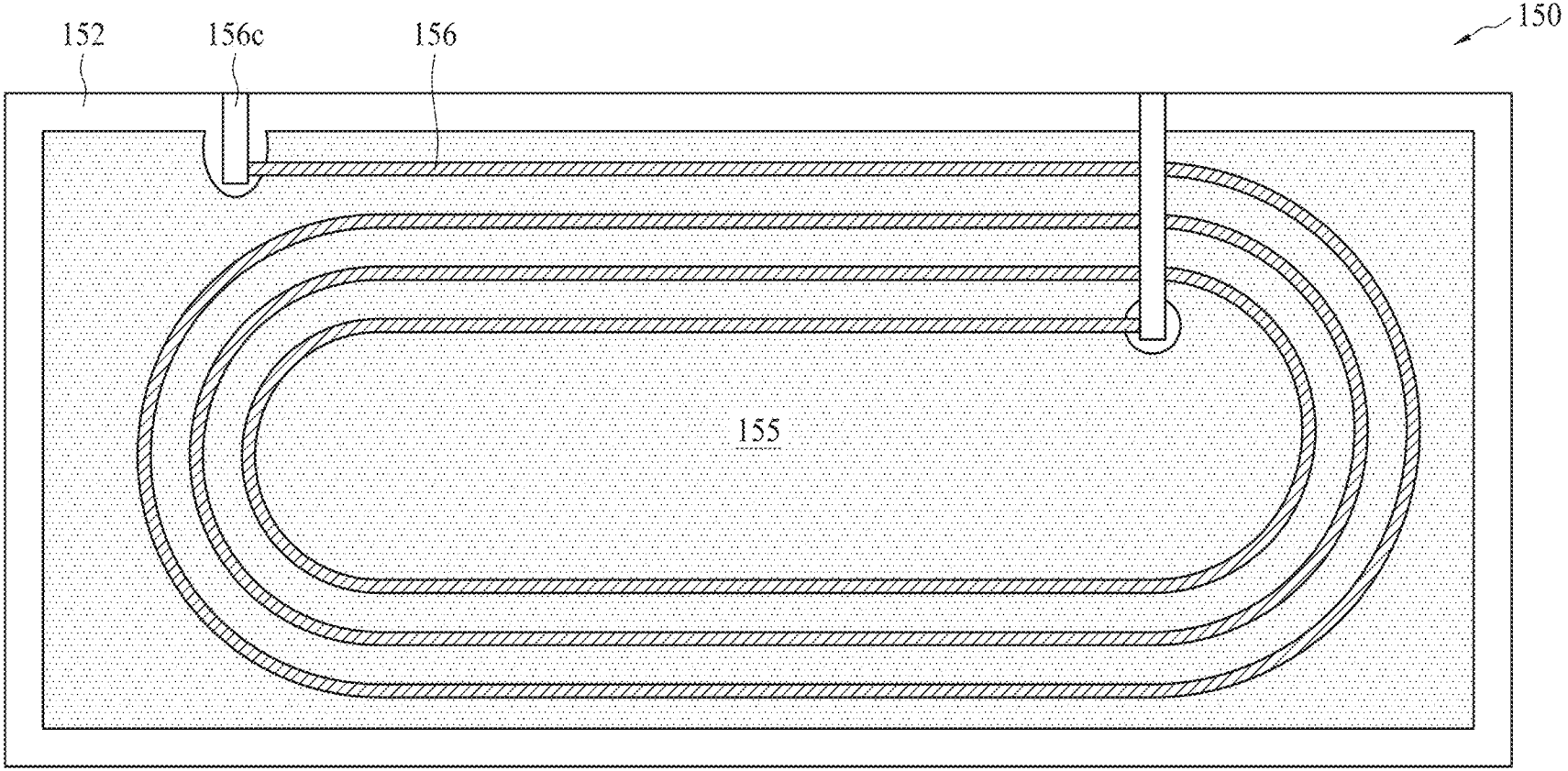

Referring to FIG. 15, the copper foil 155 and the conductive coil 156 are attached to the first substrate 110 by an adhesive layer 157. Referring to FIGS. 16A and 16B, a protecting layer 159 is formed over the conductive coil 156 and the metal foil 155. The protecting layer 159 includes insulative material. Thereafter, openings are formed in the protecting layer 159, and conductive lines 156*c* are formed to fill the openings. The conductive lines 156*c* are formed to couple to two ends of the conductive coil 156, respectively. In some embodiments, the conductive line 156*c* may include silver glue or silver paste, but the disclosure is not limited thereto. In some embodiments, the conductive coil 156 may include a multi-layered structure, and the multi-layered structure may be formed by attaching layers of the metal foil 155.

Figure 17:
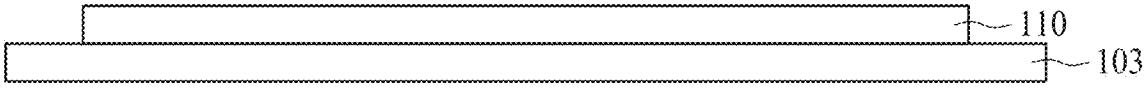
FIGS. 17 to 25 are schematic drawings of a hybrid diaphragm structure at various fabrication stages constructed according to aspects of the present disclosure in one or more embodiments.

FIGS. 17 to 25 are drawings illustrating various stages of another method for forming a hybrid diaphragm structure 200. As shown in FIG. 17, a bulk substrate is attached on a carrier substrate 103, wherein a plurality of first substrates 110 are defined in the bulk substrate. Subsequently, operations for glass strengthening may be performed. In some embodiments, the operations can include chemical strengthening. In some embodiments, homogeneous amorphous material, silicon nitride, silicon oxide, and silicon oxynitride may be coated over surfaces of the first substrate 110 for glass strengthening. In other embodiments, the chemical strengthening and coating strengthening may be alternately performed to form a hybrid structure for glass strengthening. In some embodiments, a glass thinning operation may be performed prior to the glass strengthening. The glass thinning operation may be performed on the entire first substrate 110, or performed at a location where the diaphragm 152 is to be formed. The glass thinning operation may be performed at locations where the recesses 151 and/or 153 are to be formed.

Figure 18:
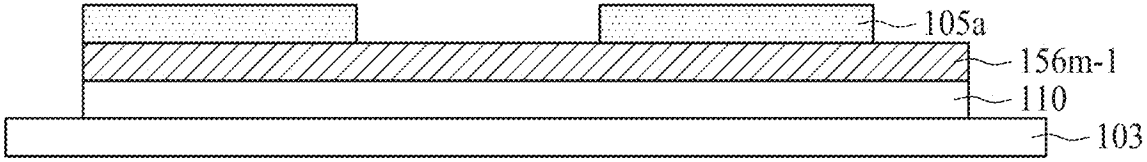
Figure 19:
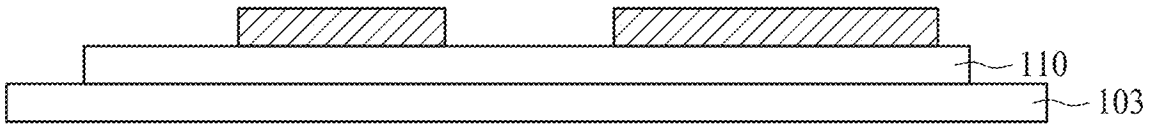

Referring to FIG. 18, a conductive layer 156*m*-1 is deposited over the first substrate 110. Subsequently, a patterned photoresist 105*a* is formed over the conductive layer 156*m*-1. The conductive layer 156*m*-1 is then etched through the patterned photoresist 105*a* to form a coil pattern. As mentioned above, the coil pattern may include patterns shown in FIGS. 2A to 2D, but the disclosure is not limited thereto. Thereafter, the patterned photoresist 105*a* is removed, as shown in FIG. 19.

Figure 20:
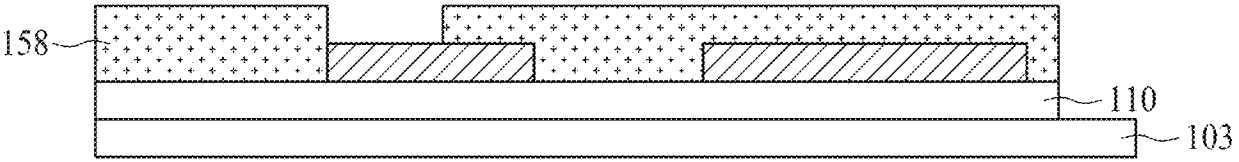
Figure 21:
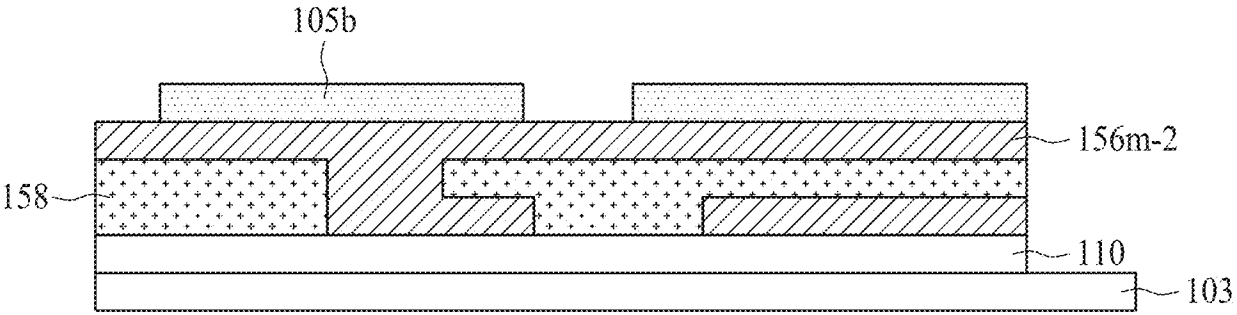
Figure 22:
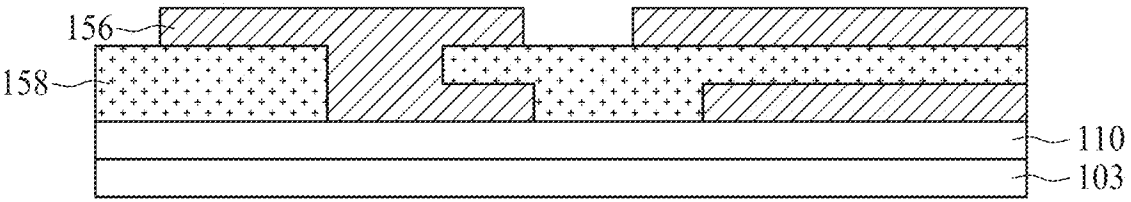

Referring to FIG. 20, an insulating layer 158 is formed on the first substrate 110 and the coil pattern. In some embodiments, the insulating layer 158 may include photoresist material, but the disclosure is not limited thereto. The insulating layer 158 may be patterned to have an opening, and a portion of the coil pattern is exposed through the opening of the insulating layer 158. Referring to FIG. 21, another conductive layer 156*m*-2 is formed over the insulating layer 158. Further, the opening is filled with the conductive layer 156*m*-2. Subsequently, another patterned photoresist 105*b* is formed over the conductive layer 156*m*-2. Referring to FIG. 22, the conductive layer 156*m*-2 is etched through the patterned photoresist 105*b* to form a coil pattern. As mentioned above, the coil pattern may include the patterns shown in FIGS. 2A to 2D, but the disclosure is not limited thereto. Further, the coil pattern over the insulating layer 158 is coupled to the coil pattern under the insulating layer 158 through the conductive layer in the opening. Thus, layers of coil patterns are connected to form the conductive coil 156.

Figure 23:
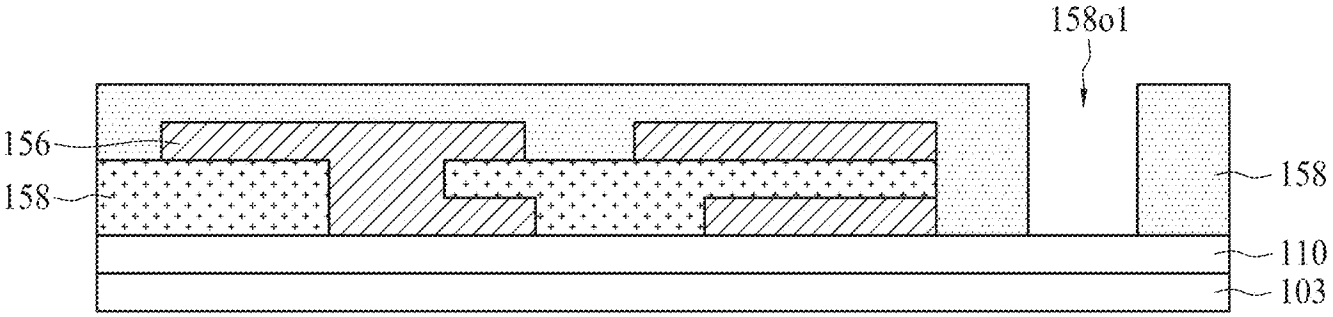

Referring to FIG. 23, another insulating layer 158 is formed to cover the conductive coil 156. As mentioned above, the insulating layer 158 may include photoresist material, but the disclosure is not limited thereto. In some embodiments, the insulating layer 158 embeds the entire conductive coil 156. Subsequently, an opening 158*o*1 is formed in the insulating layer 158, When the insulating layer 158 is formed of photoresist material, the opening 158*o*1 can be formed by a photolithography operation. Accordingly, the opening 158*o*1 is formed in the insulating layer 158, and the first substrate 110 is exposed through a bottom of the opening 158*o*1.

Figure 24:
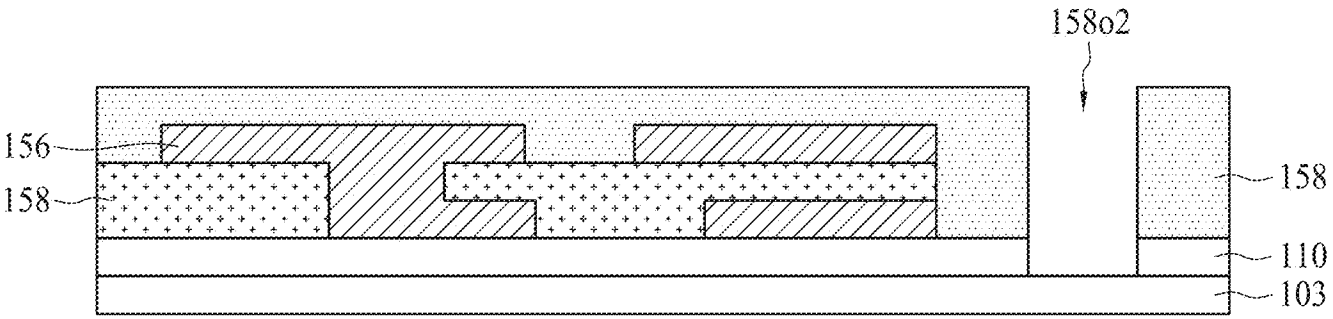
Figure 25:
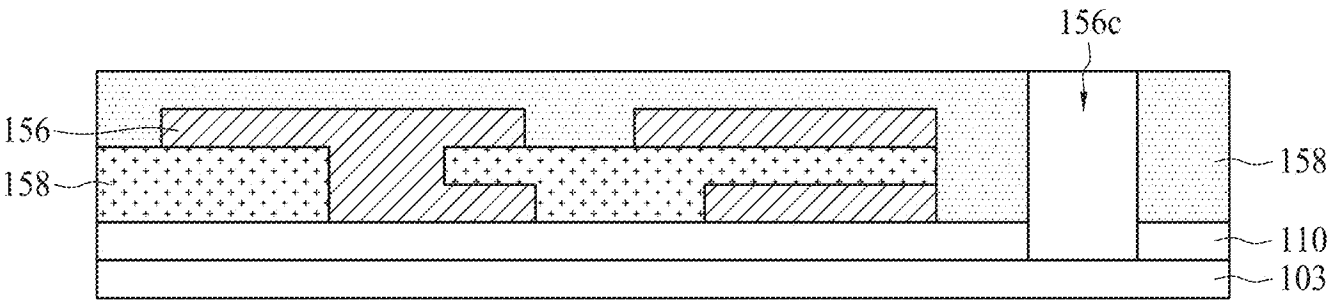

Referring to FIG. 24, in some embodiments, the first substrate 110 exposed through the bottom of the opening 158*o*1 is removed, thus deepening the opening 158*o*1 to form another opening 158*o*2. As shown in FIG. 24, the opening 158*o*2 penetrates the insulating layer 158 and the first substrate 110, thus exposing the carrier substrate 103 through a bottom of the opening 158*o*2. Referring to FIG. 25, a conductive material, such as an anisotropic conductive film (ACF) is deposited to fill the opening 158*o*2, thus forming a conductive line 156*c*. In some embodiments, the conductive line 156*c* is able to electrically connect the conductive coil 156 to the circuit disposed in the second substrate 120. Additionally, the conductive coil 156 and the insulating layers 158 are referred to as the coil structure 154.

Figure 26A:
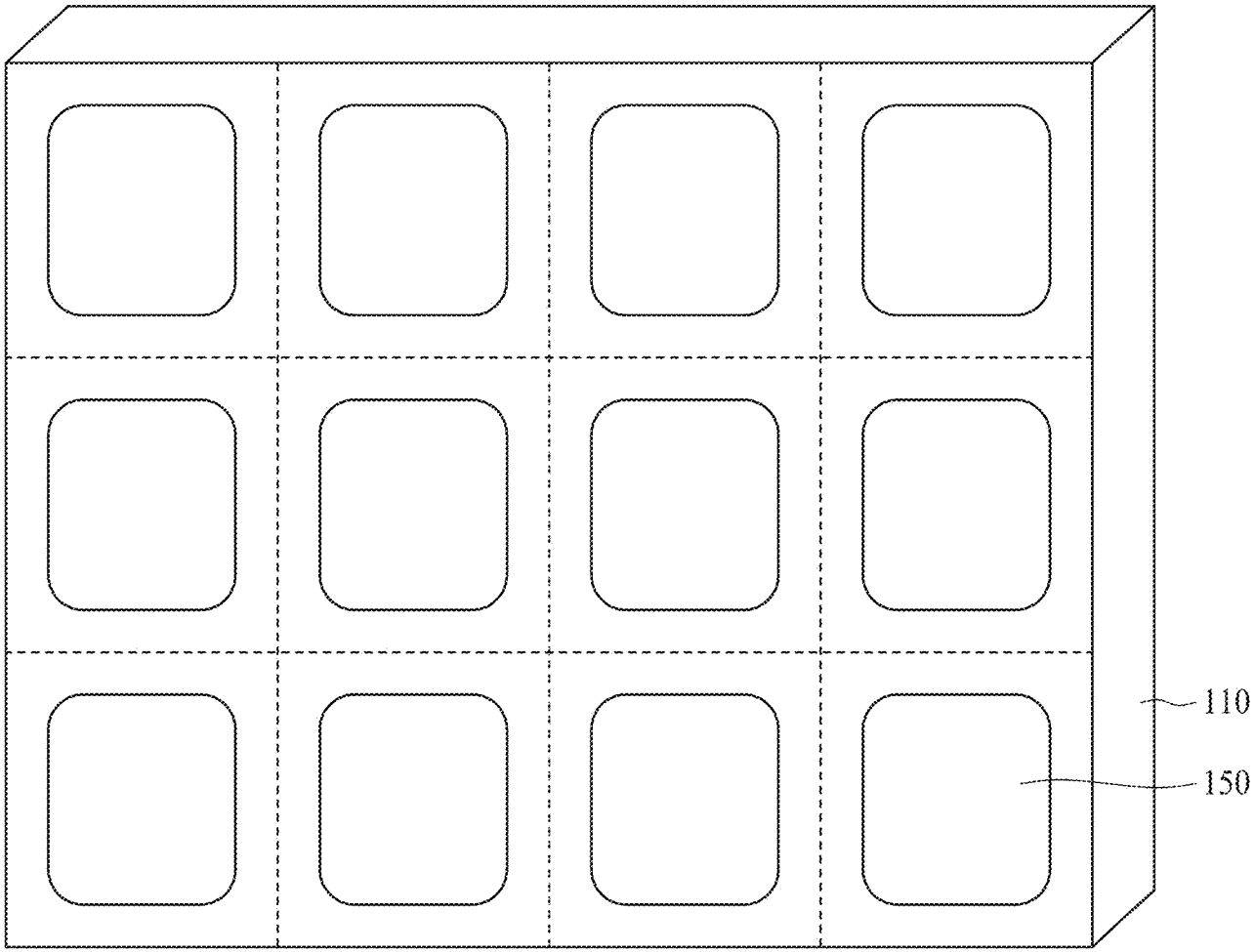
FIGS. 26A, 26B and 27 to 32 are schematic drawings of a flat diaphragm speaker at various fabrication stages constructed according to aspects of the present disclosure in one or more embodiments.

Referring to FIG. 26A, in some embodiments, a plurality of coil structures 154 may be formed in the first substrate 110 over the carrier 103. The coil structure 154 may be formed in each of the first substrates 110 by, for example but not limited thereto, the abovementioned methods. Further, the groove (not shown) may be formed in each of the first substrates 110 prior to or after the forming of the coil structures 154. Thus, a plurality of hybrid diaphragms 150 may be obtained over one carrier substrate 103, as shown in FIG. 26A.

Figure 26B:
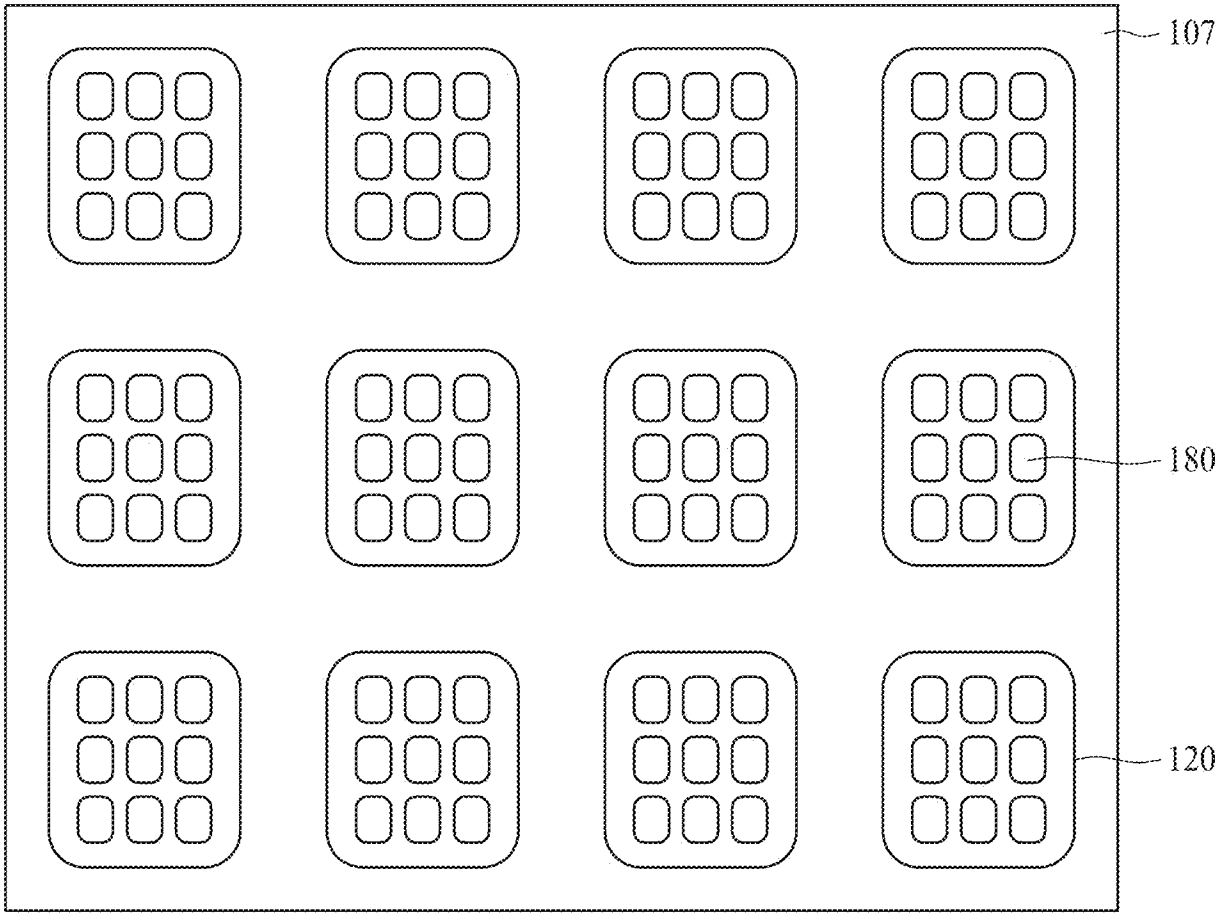

Referring to FIG. 26B, in some embodiments, a plurality of second substrates 120 are defined in another bulk substrate 107. In some embodiments, the second substrates 120 may be defined by forming a material coating that is able to prevent magnetic leakage. For example, an iron coating or a nickel coating may be formed over the bulk substrate 107, and the shape and the dimension of the material coating define a shape and a dimension of the second substrates 120. In some embodiments, at least a magnet 180 is disposed in each of the second substrates 120, as shown in FIG. 26B.

Figure 28:
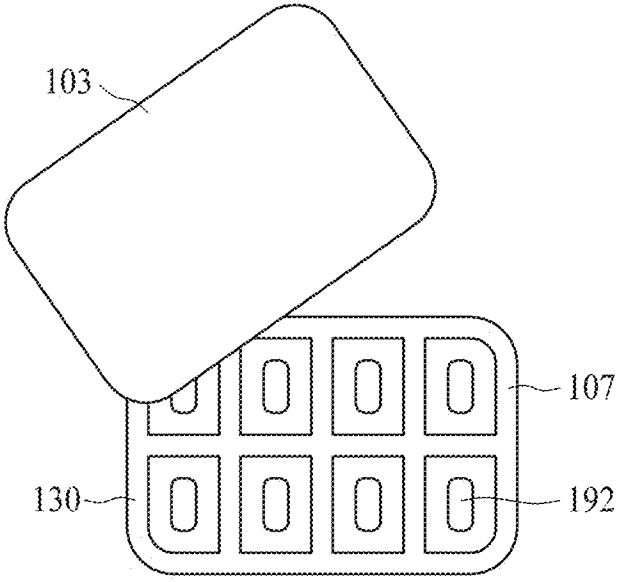
Figure 27:
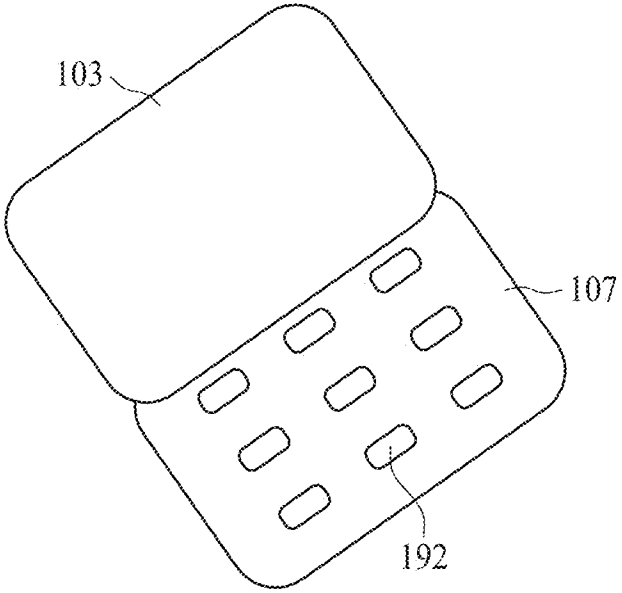
Figure 29:
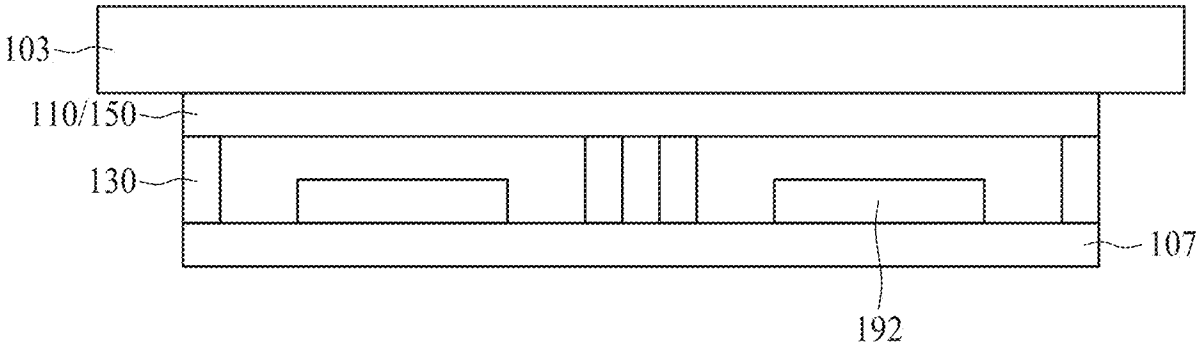
Figure 30:
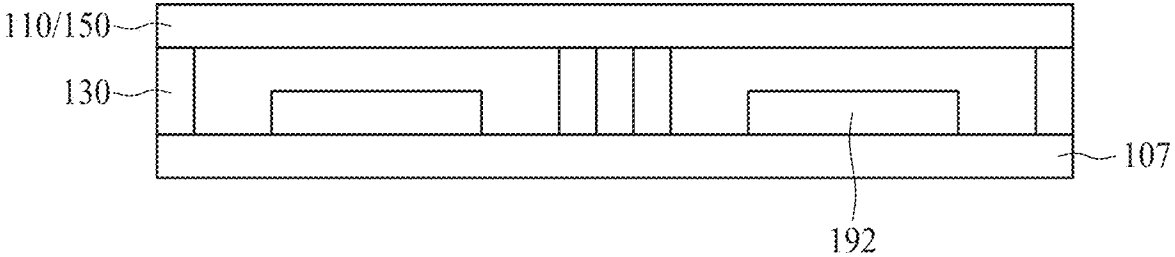
Figure 31:
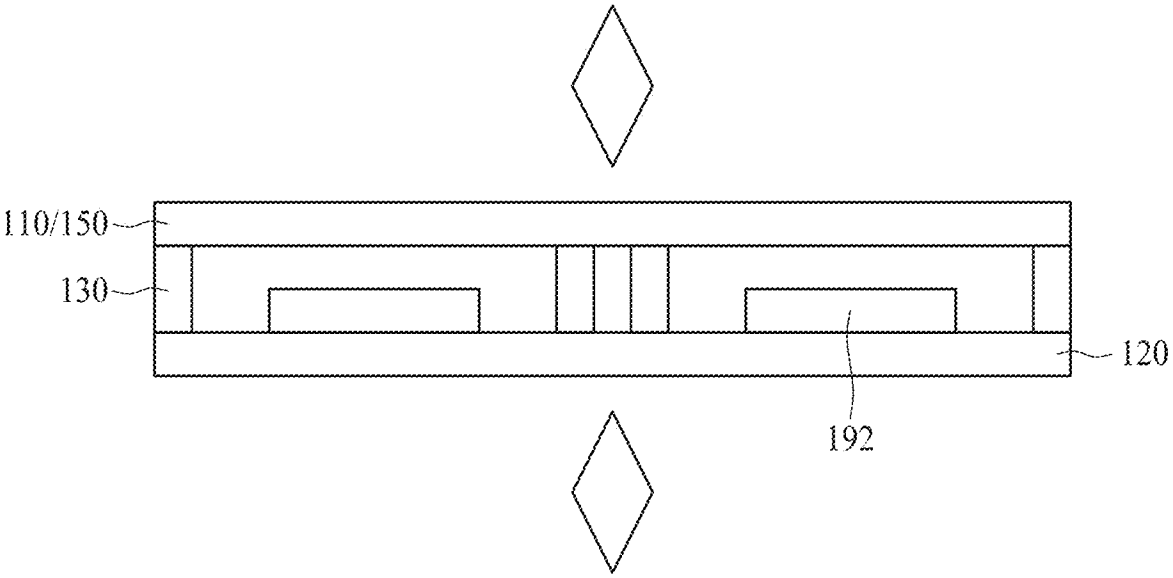
Figure 32:
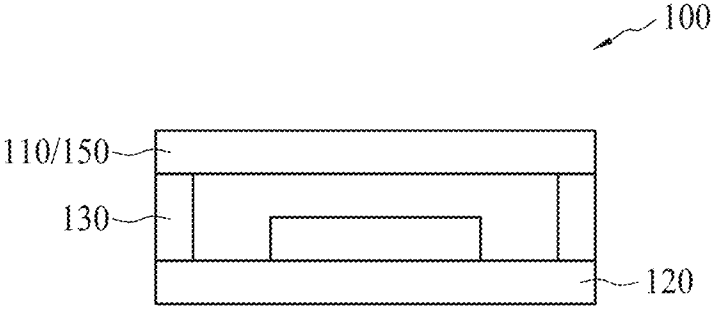

Referring to FIG. 27, the carrier substrate 103 including the hybrid diaphragm structures 150 and the bulk substrate 107 including the second substrates 120 are received. Further, the surface where the coil structures 154 are formed is arranged to face the second substrates 120. Referring to FIG. 28, sealants 130 are formed to surround each of the second substrates 120 and each of the first substrates 110. Referring to FIG. 29, the first substrates 110 are attached and fixed to the bulk substrate 107 by the sealant 130. Referring to FIG. 30, the carrier substrate 103 is removed after the attaching of the first substrates 110 to the bulk substrate 107. Referring to FIG. 31, a singulation operation is performed to cut the substrates 110 and 107. Accordingly, a flat diaphragm speaker 100 is obtained, as shown in FIG. 32.

According to the present disclosure, a hybrid diaphragm structure is provided. The hybrid diaphragm structure has a voice coil integrated on a diaphragm, thus achieving miniaturization. Further, methods for forming the hybrid diaphragm can be integrated in semiconductor manufacturing. Accordingly, a flat diaphragm speaker including the hybrid diaphragm structure may be integrated with other applications such as LED/OLED display. Thus, practicality of the flat diaphragm speaker is further improved.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A hybrid diaphragm structure of a speaker, comprising:
a substrate;
a first diaphragm disposed in a central region of the substrate;
a first coil structure disposed over the first diaphragm;
a first groove separating the first diaphragm and the first coil structure from the substrate; and
a first bridge structure coupling the first diaphragm to the substrate,
wherein the first diaphragm and the substrate comprise a same material.

2. The hybrid diaphragm structure of claim 1, wherein a depth of the first groove is equal to a thickness of the substrate.

3. The hybrid diaphragm structure of claim 2, wherein a thickness of the first diaphragm is equal to or less than the thickness of the substrate.

4. The hybrid diaphragm structure of claim 1, further comprising a material layer disposed over the first groove and coupling the substrate and the first diaphragm.

5. The hybrid diaphragm structure of claim 1, wherein the first diaphragm further comprises:
a first surface and a second surface opposite to the first surface;
a plurality of first recesses indented from the first surface toward the second surface; and
a plurality of second recesses dented from the second surface toward the first surface.

6. The hybrid diaphragm structure of claim 5, wherein the first recesses and the second recesses are alternately arranged to form a pattern.

7. The hybrid diaphragm structure of claim 6, wherein the first coil structure surrounds the pattern.

8. The hybrid diaphragm structure of claim 1, wherein the coil structure comprises multiple conductive coils and multiple insulating layers separating the conductive coils.

9. The hybrid diaphragm structure of claim 1, further comprising:
a second diaphragm disposed in a central region of the first diaphragm;
a second coil structure disposed over the second diaphragm;
a second groove separating the second diaphragm and the second coil structure from the first diaphragm; and
a second bridge structure coupling the second diaphragm to the first diaphragm,
wherein the first coil structure and the second coil structure are disposed over a same side of the hybrid diaphragm structure.

10. The hybrid diaphragm structure of claim 9, wherein a dimension of the second diaphragm is different from a dimension of the first diaphragm.

11. The hybrid diaphragm structure of claim 1, further composing:
a second diaphragm; and
a second coil structure disposed over the second diaphragm,
wherein the first diaphragm and the first coil structure are separated from the second diaphragm and the second coil structure by the substrate.

12. A flat diaphragm speaker, comprising:
a first substrate;
a second substrate having a first surface facing the first substrate and a second surface opposite to the first surface;
a frame coupling the first substrate to the second substrate;
a hybrid diaphragm disposed within the first substrate, wherein the hybrid diaphragm comprises:
a vibrating part having a third surface facing the second substrate and a fourth surface opposite to the third surface; and
a coil structure disposed over the third surface of the vibrating part;
a groove separating the hybrid diaphragm from the first substrate; and
at least a bridge structure coupling the hybrid diaphragm to the first substrate,
wherein the first substrate and the vibrating part of the hybrid diaphragm comprise a same material.

13. The flat diaphragm speaker of claim 12, wherein a thickness of the vibrating part of the hybrid diaphragm is equal to or less than a thickness of the first substrate.

14. The flat diaphragm speaker of claim 13, further comprising at least a hole penetrating the second substrate or the frame.

15. The flat diaphragm speaker of claim 12, wherein the vibrating part of the hybrid diaphragm further comprises multiple first recesses indented from the third surface toward the fourth surface and multiple second recesses indented from the fourth surface toward the third surface.

16. The flat diaphragm speaker of claim 12, further comprising a magnet disposed over the first surface of the second substrate, wherein the coil structure surrounds the magnet from a top view.

17. The flat diaphragm speaker of claim 16, further comprising a driving IC disposed over the second surface of the second substrate.

18. The flat diaphragm speaker of claim 12, further comprising a first magnet disposed over the second surface of the second substrate, wherein the coil structure surrounds the magnet from a top view.

19. The flat diaphragm speaker of claim 18, further comprising a second magnet disposed over the first surface of the second substrate.

* * * * *